US009632521B2

(12) United States Patent
Iriarte et al.

(10) Patent No.: US 9,632,521 B2
(45) Date of Patent: Apr. 25, 2017

(54) VOLTAGE GENERATOR, A METHOD OF GENERATING A VOLTAGE AND A POWER-UP RESET CIRCUIT

(71) Applicant: ANALOG DEVICES GLOBAL, Hamilton (BM)

(72) Inventors: Santiago Iriarte, Valencia (ES); Ramon Tortosa Navas, Valencia (ES); Enrique Company Bosch, Valencia (ES)

(73) Assignee: Analog Devices Global, Hamilton (BM)

( * ) Notice: Subject to any disclaimer, the term of this patent is extended or adjusted under 35 U.S.C. 154(b) by 247 days.

(21) Appl. No.: 14/205,045

(22) Filed: Mar. 11, 2014

(65) Prior Publication Data

US 2014/0266140 A1 Sep. 18, 2014

Related U.S. Application Data

(60) Provisional application No. 61/779,278, filed on Mar. 13, 2013.

(51) Int. Cl.

| | |
|---|---|
| ***G05F 1/10*** | (2006.01) |
| ***G05F 3/24*** | (2006.01) |
| *G05F 1/46* | (2006.01) |
| *G05F 1/56* | (2006.01) |
| *G05F 1/567* | (2006.01) |

(52) U.S. Cl.

CPC ..... *G05F 3/242* (2013.01); *G05F 1/46* (2013.01); *G05F 1/461* (2013.01); *G05F 1/462* (2013.01); *G05F 1/56* (2013.01); *G05F 1/567* (2013.01)

(58) Field of Classification Search

None

See application file for complete search history.

(56) References Cited

U.S. PATENT DOCUMENTS

| | | | | |
|---|---|---|---|---|
| 4,727,309 | A * | 2/1988 | Vajdic | G05F 3/247 323/312 |
| 5,422,563 | A * | 6/1995 | Pflueger | G05F 1/575 323/312 |
| 5,847,586 | A | 12/1998 | Burstein et al. | |
| 6,137,324 | A | 10/2000 | Chung | |
| 6,452,414 | B1 | 9/2002 | Lorenz | |
| 6,472,912 | B1 | 10/2002 | Chiu et al. | |
| 6,593,790 | B2 | 7/2003 | Kim | |
| 6,650,154 | B2 | 11/2003 | Okuyama | |

(Continued)

OTHER PUBLICATIONS

R. A. Blauschild, P. A. Tucci, R. S. Muller and R. G. Meyer, "A new NMOS temperature stable voltage reference", IEEE Journal of Solid-State Circuits, vol. SC-13, No. 6, Dec. 1978, pp. 767-774.

(Continued)

*Primary Examiner* — Tuan T Lam

(74) *Attorney, Agent, or Firm* — Knobbe, Martens, Olson & Bear, LLP

(57) ABSTRACT

A voltage generator is provided which is reliable, self starting and only requires a few components. The voltage generator comprises a first stage that provides a current to a second stage. The first stage has a temperature coefficient of one sign, such as positive, and the second stage has an opposing temperature coefficient, e.g. negative. The responses are summed such that the overall temperature coefficient is reduced.

31 Claims, 22 Drawing Sheets

(56) References Cited

U.S. PATENT DOCUMENTS

| | | | | |
|---|---|---|---|---|
| 6,879,194 | B1 | 4/2005 | Caldwell | |
| 6,894,544 | B2 | 5/2005 | Gubbins | |
| 7,161,396 | B1 | 1/2007 | Zhou et al. | |
| 7,426,146 | B2 * | 9/2008 | Aota | G11C 5/147 365/189.09 |
| 7,436,226 | B2 | 10/2008 | Kim | |
| 7,450,359 | B1 | 11/2008 | Mei et al. | |
| 7,808,387 | B1 | 10/2010 | Kuhn | |
| 7,893,734 | B2 | 2/2011 | Garcia et al. | |
| 8,049,483 | B2 * | 11/2011 | Yamamoto | G05F 3/185 323/313 |
| 8,212,545 | B2 * | 7/2012 | Imura | G05F 3/24 323/313 |
| 8,305,134 | B2 * | 11/2012 | Hirose | G05F 3/242 327/513 |
| 8,358,119 | B2 * | 1/2013 | Kim | G05F 3/242 323/313 |
| 8,519,782 | B2 * | 8/2013 | Oyama | H03K 5/2481 327/540 |
| 2003/0052661 | A1 * | 3/2003 | Tachimori | G05F 3/242 323/313 |
| 2003/0098727 | A1 | 5/2003 | Okuyama | |
| 2005/0073341 | A1 | 4/2005 | Lim | |
| 2006/0164136 | A1 | 7/2006 | Shin | |
| 2010/0072972 | A1 * | 3/2010 | Yoshikawa | G05F 3/30 323/313 |
| 2010/0109742 | A1 | 5/2010 | Honda | |
| 2010/0327842 | A1 * | 12/2010 | Seok | G05F 3/242 323/313 |
| 2011/0068829 | A1 | 3/2011 | Ogawa et al. | |
| 2011/0074470 | A1 | 3/2011 | Sanborn et al. | |
| 2012/0092047 | A1 | 4/2012 | Chen et al. | |
| 2012/0117410 | A1 | 5/2012 | Jeong et al. | |
| 2012/0229183 | A1 | 9/2012 | Lee | |
| 2014/0266314 | A1 | 9/2014 | Iriarte et al. | |

OTHER PUBLICATIONS

H. J. Oguey and B. Gerber, "MOS voltage reference based on polysilicon gate work function difference", IEEE Journal of Solid-State Circuits, vol. SC-15, No. 3, Jun. 1980, pp. 265-269.

H.-J. Song and C.-K. Kim, "A temperature-stabilized SOI voltage reference based on threshold voltage difference between enhancement and depletion NMOSFETs", IEEE Journal of Solid-State Circuits, vol. 28, No. 6, Jun. 1993, pp. 671-677.

S. Adriaensen, V. Dessard, D. Flandre, "25 to 300° C. ultra-low-power voltage reference compatible with standard SOI CMOS process", Electronics Letters, vol. 38, No. 19, Sep. 12, 2002, pp. 1103-1104.

X. Xia, et al., "Temperature-stable voltage reference based on different threshold voltage of NMOS transistors", IET Circuits, Devices & Systems, vol. 3, iss. 5, 2009, pp. 233-238.

M. Seok, et al., "A portable 2-transistor picowatt temperature-compensated voltage reference operating at 0.5 V", IEEE Journal of Solid-State Circuits, vol. 47, No. 10, Oct. 2012, pp. 2534-2545.

A. Katyal and N. Bansal, "A Self-Biased Current Source Based Power-On Reset Circuit for On-Chip Applications", 2006 International Symposium on VLSI Design, Automation and Test, IEEE, 2006, pp. 1-4.

T. Tanzawa, "A process—and temperature-tolerant power-on reset circuit with a flexible detection level higher than the bandgap voltage", IEEE International Symposium on Circuits and Systems, 2008, pp. 2302-2305.

Zhang, et al., "Design of a Novel Power-on-Reset Circuit Based on Power Supply Detector", International Conference on Scalable Computing and Communications; Eighth International Conference on Embedded Computing, IEEE, 2009, pp. 355-359.

* cited by examiner $$V_1 = V_{10} + K_1(T-T_o)$$

$$V_2 = V_{20} + K_2(T-T_o)$$

$$V_{REF} = 2V_{GS} - \left(1 + \frac{R_2}{R_1}\right) V_{GSN}$$

$$V_{REF} = 2^* (V_{GS} - V_{GSN})$$

$$V_{REF} = 2V_{GS} - \left(1 + \frac{X_1}{X_2}\right) V_{GSN}$$

$$V_{REF} = 2^* (V_{GS} - V_{GSN})$$

VOLTAGE GENERATOR, A METHOD OF GENERATING A VOLTAGE AND A POWER-UP RESET CIRCUIT

TECHNICAL FIELD

Embodiments of the present invention relate to a reference voltage generator, a method of generating a reference voltage and to a power-up reset circuit including such a reference voltage generator.

BACKGROUND

In many electronic circuits it is desirable to generate a relatively well known voltage against which other voltages may be compared. Such a reference voltage is typically provided by a component known as a "reference voltage generator". It is further known that electronic devices, such as transistors, have electrical characteristics that vary as a function of temperature. This can affect the output voltage of a reference voltage generator, and consequently some reference voltage generator circuits which are substantially temperature compensated can be quite complex. As a result such circuits may draw relatively large amounts of current or may require significant voltage headroom in order to be able to operate correctly. Such circuits may also take up relatively large amounts of area on the chip.

SUMMARY

According to a first aspect there is provided a voltage generator comprising first and second coupled stages, wherein the first stage has a voltage versus temperature characteristic of an opposite sign to a voltage versus temperature characteristic of the second stage, and in which the first stage comprises a first transistor having a gate, a drain and a source, and a first resistive element, which may be provided by a first resistor or a transistor. A first node of the first resistive element is connected to the source of the first transistor, a second node of the first resistive element is connected to the gate of the first transistor, and the first transistor is configured to pass a current when its gate voltage is approximately the same as its source voltage.

Advantageously, the voltage versus temperature characteristic of the first stage is substantially complementary to (but not necessarily the same magnitude as) the voltage versus temperature characteristic of the second stage. To a first order approximation, the change in output voltage versus temperature from the voltage generator may be substantially linear and should be less than that of the temperature characteristic of either of the first or second stages.

Preferably the second stage comprises a second semiconductor device, such as a second transistor.

In an embodiment, the second stage may comprise at least one diode connected field effect transistor, or a transistor in a feedback loop arranged to cause a desired current to flow in the second transistor.

The first and second transistors may be of substantially the same type (such as n-type or p-type) and/or be manufactured during the same process. Thus, process variations during manufacture of the first and second transistors affect each transistor by substantially the same amount. However, the processing steps in the fabrication of the first and second transistors may be varied such that the transistors have different threshold voltages. Thus, in the case of, for example, NMOS transistors, the first transistor may be doped such that its threshold voltage is lower than that of the threshold voltage of the second transistor.

The first transistor may be a "native" transistor. Such a transistor may also be known as a "natural transistor". Its properties can be regarded as intermediate that of enhancement and depletion mode devices. As known to the person skilled in the art, doping in the channel of a field effect transistor can be controlled to switch the device between enhancement and depletion modes by controlling the extent of the depletion boundaries within the semiconductor device. Alternatively the first transistor may be a depletion mode device. Both native and depletion mode FETs can pass a current when the difference between their drain and source voltages is 0V. In this context, passing a current means passing more current than a leakage current in a nominal "off" state. For the avoidance of doubt, in an N type FET taking the gate voltage increasingly positive with respect to the source of the FET causes a drain current to increase in both enhancement mode devices and depletion mode devices. However in an enhancement mode device there is substantially no channel current until the gate voltage is more positive than the source voltage by a threshold voltage. In a depletion mode device the transistor conducts when the gate is at the same voltage as the source, and the gate needs to be taken negative with respect to the source (and drain) voltage to make the transistor non-conducting. P type devices are similarly divided into depletion mode and enhancement mode devices.

The first stage may have a temperature coefficient of a first sign which is opposite (i.e., of different sign) to the temperature coefficient of the second stage. The first stage may include a circuit arranged to synthesize the first temperature coefficient from a device which has a temperature coefficient of the second sign.

The second stage may, as an alternative to use of a FET, comprise at least one bipolar transistor or at least one diode. The bipolar transistor may be diode connected or controlled by a feedback circuit.

The first and second stages are coupled such that related currents flow through them. In some embodiments the first and second stages may be arranged in series such that the same current flows in each stage. In other arrangements a current minor may be used to couple the first and second stages. Thus the current in the first stage may be transferred to the second stage by the current minor. The current minor may have a transfer ratio such that the current $I_2$ transferred to the second stage is $I_2=b_1I_1$ where $I_1$ is the current in the first stage, and $b_1$ is a transfer coefficient.

According to a second aspect there is provided a method of generating a reference voltage, the method comprising providing a voltage to a reference generator comprising first and second coupled stages, wherein the first stage has a temperature coefficient of a first sign, and the second stage has a temperature coefficient of a second sign opposite that of the first sign, and wherein the first stage comprises a first resistive element and first transistor having a gate, a drain and a source, wherein a first node of the first resistive element is connected to the source of the first transistor, a second node of the first resistive element is connected to a gate of the first transistor, and the first transistor is operable to pass a current when its gate voltage is the same as its source voltage.

The first stage synthesizes a temperature coefficient of the first sign from a device that has a temperature coefficient of the second sign.

The second stage preferably includes a component having a negative temperature coefficient, such that, for example, at a fixed current, a voltage across the component decreases with increasing temperature.

According to a further aspect there is provided a power up reset generator including a voltage reference according to the first aspect.

BRIEF DESCRIPTION OF THE DRAWINGS

Embodiments of the invention will now be described, by way of non-limiting example only, with reference to the accompanying Figures, in which.

DETAILED DESCRIPTION OF SOME EXAMPLE EMBODIMENTS

It is often desirable to provide a reference voltage in an electronic circuit. A reference voltage generator should produce a reference voltage that is substantially constant with respect to temperature. Generally, semiconductor devices do not satisfy this condition.

Figure 1:
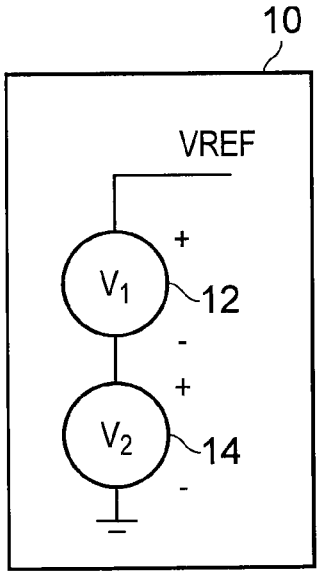
FIG. 1 schematically illustrates a reference voltage generator having series connected voltage references.

FIG. 1 schematically illustrates a reference voltage generator generally indicated 10, comprising a first stage 12 generating a first voltage reference $V_1$ and a second stage 14 generating a second voltage reference $V_2$. The output voltage Vref of the voltage generator 10 of FIG. 1 is a sum of the reference voltages $V_1$ and $V_2$.

In general, the first stage 12 generating the first voltage $V_1$ will have a temperature coefficient $K_1$. Thus, to a first approximation the output voltage $V_1$ can be written as:

$$V_1(T)=V_{10}+K_1(T-T_0)$$

where $V_{10}$ equals the output voltage $V_1$ at an arbitrary reference temperature $T_0$, $K_1$ represents a temperature coefficient $$\frac{dV_1}{dT},$$

and

T represents the temperature.

Similarly the second stage generating the second reference voltage $V_2$ will have a second temperature coefficient $K_2$ and consequently its output voltage can be expressed as:

$$V_2=V_{20}+K_2(T-T_0)$$

where $V_{20}$ represents the output voltage $V_2$ at the arbitrary reference temperature $T_0$, $K_2$ represents a temperature coefficient $$\frac{dV_2}{dT},$$

and

T represents the temperature.

For reference voltage circuits based on field effect transistors, these temperature dependent terms $K_1(T-T_0)$ and $K_2(T-T_0)$ can be related to changes in threshold voltage $V_{TH}$ as a function of temperature.

As is known to the person skilled in the art, the threshold voltage $V_{TH}$ of a field effect transistor, decreases in magnitude as the temperature increases. In some transistor models, such as the Schichman-Hodges model, the models include a term for the variation of threshold voltage with respect to temperature.

Thus, the Schichman-Hodges model calculates:

$$V_{TN}=V_{TO}+\gamma(\sqrt{|V_{SB}+2\phi_f|}-\sqrt{|2\phi_f|})$$

where $V_{TN}$=threshold voltage when a substrate bias is present;

$V_{TO}$=threshold voltage for zero substrate bias, $V_{SB}$=source-body substrate bias, $$\gamma=(T_{OX}/\epsilon_{OX})\sqrt{2q\epsilon_{SI}N_A}$$

$$\phi_f=(kT/q)\mathrm{Ln}(N_A/N_I)$$

$T_{OX}$=oxide thickness $\epsilon_{OX}$=oxide permittivity $\epsilon_{SI}$=silicon permittivity q=charge of an electron $N_A$=doping parameter $N_I$=intrinsic doping parameter for the substrate T=temperature (Kelvin)

k=Boltzmann's constant

Other expressions are also known. For example Ho-Jun Song and Choong-Ki Kim, in their paper "A temperature-stabilised SOI voltage reference based on Threshold voltage difference between Enhancement mode and Depletion NMOSFETS", IEEE Journal of solid-state circuits, Vol. 28, No. 6 Jun. 1993, give the following equations of the threshold voltage.

For an enhancement MOSFET, the threshold $V_{TF}$ can be represented as:

$$V_{TE} = V_{FFB} + 2\phi_F + \frac{Q_{si}}{2C_{of}} - \alpha\left(V_{GBS} - V_{BFB} - 2\phi_F - \frac{Q_{si}}{2C_{ob}}\right)$$

and for a depletion mode device, the threshold $V_{TD}$ can be represented as $$V_{TD} = V_{FFB} - \frac{Q_{si}}{C_{of}} - \frac{Q_{si}}{2C_{si}} - \beta(V_{GBS} - V_{BFB})$$

$$\text{where } \alpha = \frac{C_{ob}}{C_{of}} \cdot \frac{C_{si}}{C_{ob} + C_{si}}$$

$$\beta = \frac{C_{ob}}{C_{of}} \cdot \frac{C_{si}}{C_{of} + C_{si}}$$

$Q_{si}=qN_At_{si}$ or $qN_Dt_{si}$ $V_{FFB}$=front gate flat band voltage $V_{BFB}$=back gate flat band voltage $C_{of}=\epsilon_{OX}/t_{of}$ $C_{ob}=\epsilon_{OX}/t_{ob}$ $C_{si}=\epsilon_{si}/t_{si}$ $\epsilon_{si}$=permittivity of silicon $\epsilon_{OX}$=permittivity of $S_1O_2$ $t_{si}$=thickness of the $S_1$ film $t_{of}$=thickness of front gate oxide $t_{ob}$=thickness of back gate oxide $$\phi_F = \frac{KT}{a}$$

$\mathrm{In}(N_A/n_i)$ is the Fermi potential of the neutral p-type $S_i$ film $V_{GBS}$=back gate voltage $N_A$=doping concentration of P-type silicon $N_D$=doping concentration of n-type silicon Once again this shows a temperature dependence of the threshold voltage, as well as several other parameters that also change the threshold voltage.

Figure 2:
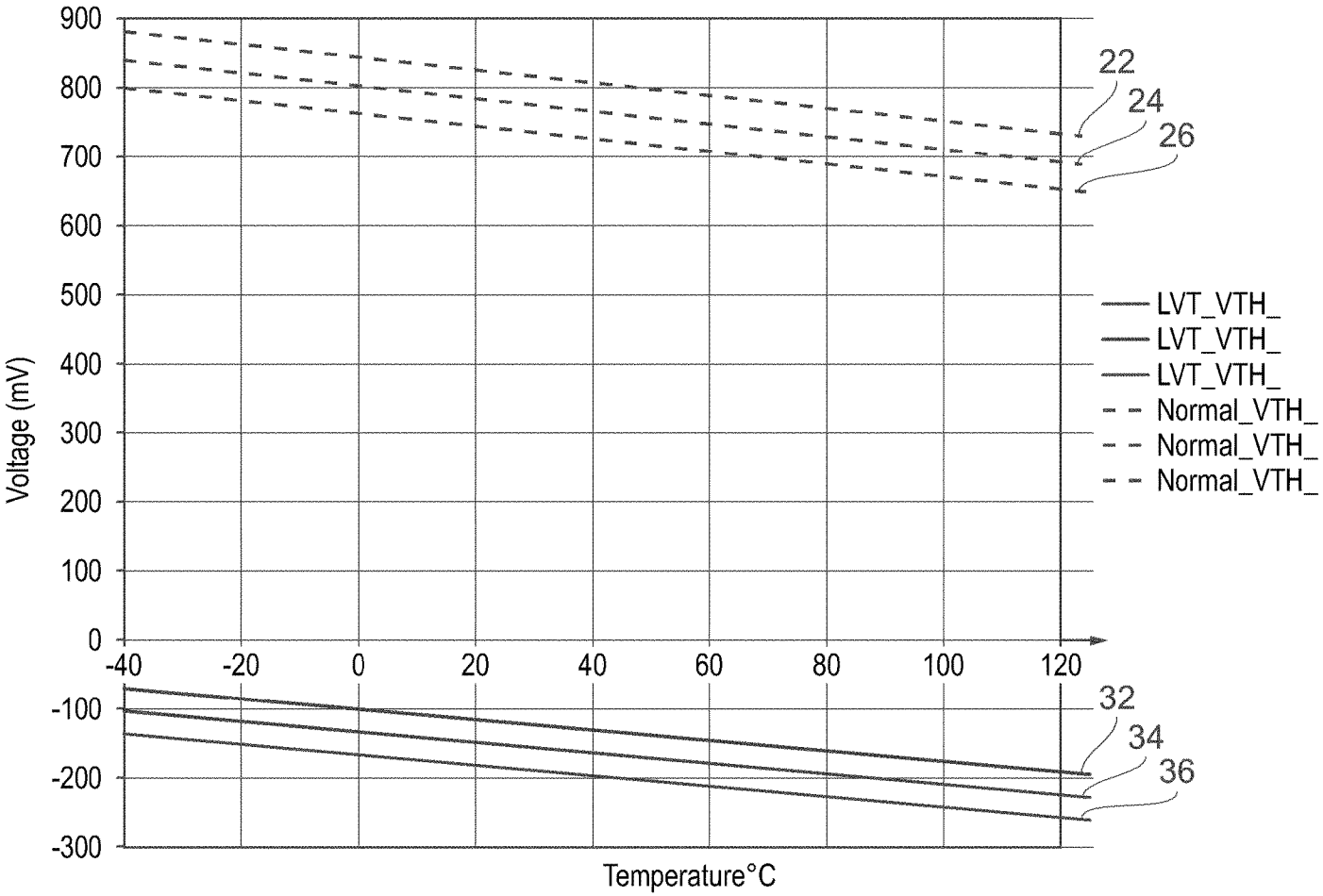
FIG. 2 is a plot showing threshold voltage versus temperature for similar native and normal NMOS transistors.

This shows that the threshold voltage varies with temperature and with doping concentration, and that the rate of change depends on doping concentrations. Therefore, for an N type FET such as a MOSFET, the threshold voltage measured with respect to the source voltage decreases (becomes more negative) as the temperature increases. FIG. 2 is a graph showing six plots of threshold voltage $V_{TH}$ versus temperature. Three of the plots are for three enhancement mode (normal) N type (such as NMOS) transistors and three of the plots are for three native N type (such as NMOS) transistors. In each case, the transistors are notionally the same size and have the same notional aspect ratio. Transistors in this example have a width to length ratio for the channel of about 10 to 1.2 units. Furthermore, the doping concentration and process steps used to form the native and normal transistors are substantially the same as each other where those steps can be shared. Thus, the substrates are assumed to have the same starting concentration, if the transistors are formed in a well, the well doping is assumed to be the same. The drain and source dopings are also assumed to be the same. The transistors vary in the threshold doping used to set the nominal threshold of the device.

In a first fabrication of an enhancement mode device, which herein will also be referred to a "normal transistor" or "normal device" and a corresponding native device, the normal device has a temperature characteristic indicated by line 22 and the native device has a temperature characteristic indicated by the line 32.

In a second fabrication, where a process variation occurred, the normal device has a temperature characteristic indicated by the line 24 and the native device has the characteristic indicated by the line 34. In third fabrication where a further process variation has occurred, the normal device has a temperature characteristic indicated by the line 26 and the native device has a temperature characteristic indicated by the line 36.

As shown in FIG. 2, for both the normal transistor and the native transistor the temperature coefficient is negative, in that the gradient of the graph is negative from left to right in FIG. 2.

The plots of FIG. 2 also indicate that process variations effect the normal and native transistors in similar ways. Thus a process variation which causes the threshold voltage to drop for the normal transistor also causes the threshold voltage to drop (or become more negative) for the corresponding native transistor. However, the change in threshold voltage at a given temperature may differ between the normal and native transistors.

Although the signs of the temperature coefficients are the same, their magnitudes need not be as shown in FIG. 2. Thus, the normal transistor having characteristics corresponding to the line 24 has a threshold voltage which drops by substantially 100 mV between 0° and 110° C. whereas the corresponding native device characteristic where the threshold voltage reduces by approximately 80 mV over the same temperature range. Similar observations occur when comparing enhancement mode devices with depletion mode devices.

The inventors have realized that these characteristics could be exploited to provide an inexpensive voltage reference that gives relatively good performance. Furthermore, such a voltage reference can operate with a relatively low voltage headroom and can be self starting.

Figure 3:
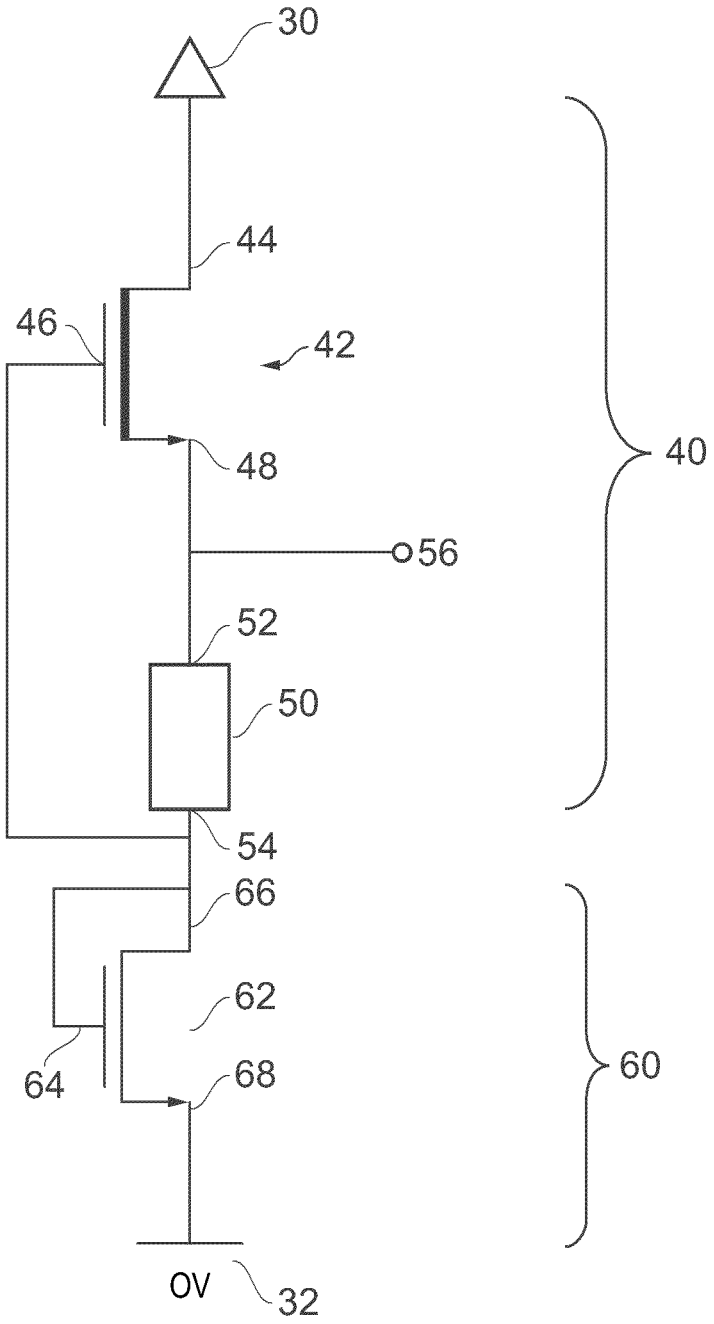
FIG. 3 shows a first embodiment of a reference voltage generator.

FIG. 3 is a circuit diagram of a first embodiment of a reference voltage generator 10 which is connected to a voltage supply 30. The reference voltage generator comprises a first stage, generally indicated 40, coupled by a series connection with a second stage generally indicated 60. As illustrated, the first stage 40 comprises a first field effect transistor 42 having a drain 44, a gate 46 and a source 48. The first stage also comprises a first resistor 50 having a first node 52 representing one end of the resistor 50 and a second node 54 representing a second end of the resistor 50. The first node 52 of the resistor is connected to the source 48 of the first transistor. This connection also defines an output node 56 out of which the reference voltage Vref is delivered by the reference voltage generator. The second node 54 of the first resistor 50 is connected to the gate 46 of the first transistor 42. The first resistor 50 or any of the other resistors described herein can alternatively be implemented with any other suitable resistive element.

The second stage 60 is in series connection with the first stage 40. As illustrated, the second stage 60 comprises a second field effect transistor 62 in a diode connected configuration. Thus a gate 64 of the second transistor 62 is connected to a drain 66 of the second transistor 62. A source 68 of the second transistor 62 is connected to a supply rail 32, such as zero volts as illustrated, against which other voltages in the circuit are referenced.

The drain 44 of the first transistor 42 is connected to receive an input voltage to the reference voltage generator from the voltage supply 30. This may be derived directly from the power supply to the circuit that includes the reference voltage generator.

The circuit shown in FIG. 3 has the advantages that it is self starting and that the variation of output voltage at the node 56 is less than the variation of threshold voltage of either of the transistors with respect to temperature.

We may initially assume that the circuit in FIG. 3 is in an unpowered state. As a result, the voltages at all of the terminals of the transistors can be assumed to be zero volts. We can assume that the power supply for the circuit is switched on and that the voltage at the drain 44 of the first transistor 42 rises, either abruptly, or as a ramp, to a nominal input voltage Vin.

The first transistor 42 has the property that it conducts current when its gate voltage 46 is the same as its source voltage 48. The first transistor 42 also has the property of conducting some current, although increasingly reduced amounts, as the voltage at its source 48 becomes increasingly positive with respect to the voltage at its gate 46. Therefore the first transistor is either a native device or a depletion mode device, and this is indicated in FIG. 3 and the other figures by use of thicker shading between the source and the drain. Thus, at power-on the transistor 42 starts to conduct a current. The current flows through the resistor 50 and to ground via the transistor 62 which as will be explained later is able to conduct a current even for sub-threshold voltage operation. Thus, the voltage at the first node 52 of the resistor 50 is more positive than the voltage at the second node 54 of the resistor 50. Put another way, as the current flow starts to increase the voltage of the gate 46 becomes increasingly negative compared to the voltage at the source 48. This continues until an equilibrium condition is reached where the first stage 40 acts to provide a substantially uniform current. This current flows through the diode connected transistor 62.

Because the transistor 62 is in diode connected configuration, the voltage at its drain substantially equals the voltage at its gate and can equate to whatever gate source voltage is required to pass the current flow being provided to the transistor 62. The reference voltage Vref can be represented as:

$$V\text{ref}=V_{gs2}(I)+IR_1$$

where $V_{gs2}(I)$ equals the gate-source voltage for the second transistor required to give rise to a drain current I, I equals the current provided by the first stage 40, and $R_1$ equals the value of the first resistor.

However, due to the action of the feedback loop around the first transistor 42, we know that $$IR_1=-_{gs1}(I)$$

Thus, the reference voltage can be represented by:

$$V\text{ref}=V_{gs2}(I)-V_{gs1}(I)$$

It can be seen that the reference voltage generator 10 is self starting.

Suppose that the reference voltage generator 10 were powered up at a temperature $T_1$. If a change in temperature dT were to occur, then the threshold voltage $V_{TH}$ and consequently the gate-source voltage $V_{gs}$, for the first transistor 42 decreases by a value $K_1dT$ for a constant current. Similarly, the threshold voltage of the second transistor 62 can decrease by a value $K_2dT$.

From inspection of the circuit diagram, it can be seen that the voltage at the second node 54 of the resistor 50 is, in this example, approximately equal to the gate voltage of the second transistor 62 and also approximately equal to the gate voltage of the first transistor 42. Working our way upwards from the zero voltage line, we can see that the voltage at the second node 54 changes from $V_{gs2}(I)$ to $V_{gs2}(I)-K_2dT$.

The voltage at the output node 56 is related to the voltage at the second node 54 of the resistor 50 by $V_{gs}$ of the first transistor 42. If we assume for a given drain-source current I, that the gate-source voltage $V_{gs1}$ of the first transistor 42 can be expressed as:

$$V_{gs1}(I)=V_{TH}+C$$

For small currents this can be conveniently further simplified to $V_{gs1}\approx V_{TH1}$ where $V_{TH1}$ is the threshold voltage of the first transistor. This assumption will be discussed later with reference to FIG. 8.

It can be seen from the above equation that a change in the threshold voltage $V_{TH}$ gives rise to a corresponding change in gate-source voltage $V_{gs}$, provided that the current remains substantially the same.

We can also see that the voltage difference dropped across the resistor 50 from the first node 52 to the second node 54 is $-V_{gs1}$. Thus, the voltage at the output node 56 is related to the voltage at the second node 54 by $-V_{gs1}$ or approximated by $-V_{TH}$.

Thus, as the threshold voltage $V_{TH1}$ of the first transistor 42 drops or becomes more negative with increasing temperature, the voltage at the output node 56 increases (becomes more positive) with respect that at the second node 54. Thus the output voltage Vref at a temperature $T_1$+dT can be expressed as:

$$Vref\ (T_1+dT)=V_{gs2}(I)-K_2dT-V_{gs1}(I)+K_1dT$$

By comparison to the equation that does not account for a change in temperature dT, it can be seen that the temperature coefficient becomes $K_1-K_2$.

It can be seen that the temperature coefficient is reduced, but it is not reduced to be substantially zero unless $K_1=K_2$. The data presented in FIG. 2 shows that the magnitude of the temperature coefficient for the native device was less than that of the normal device. This can be exploited to achieve more accurate temperature compensation as will now be discussed.

Figure 4:
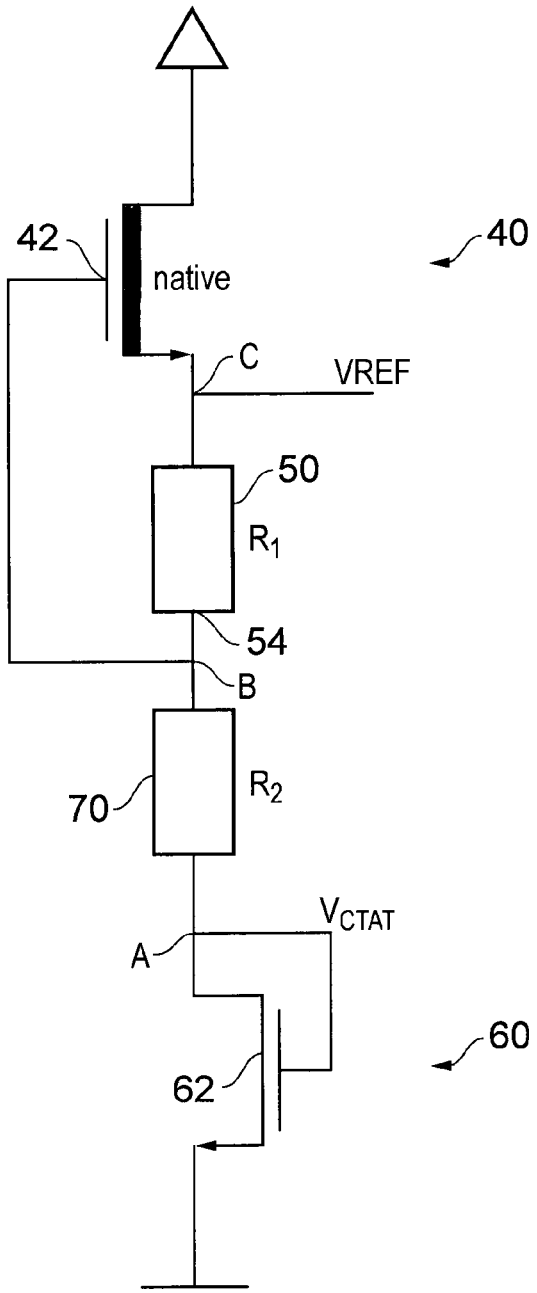
FIG. 4 shows a modification to the reference voltage generator of FIG. 3.

FIG. 4 shows a variation of the arrangement shown in FIG. 3 where the second stage 60 is modified to include a second resistor 70 having resistance $R_2$ interposed between the second node 54 of the first resistor 50 and the drain 66 of the second transistor 62. The circuit in FIG. 4 works similarly to the circuit in FIG. 1, with the first stage formed of the first transistor 42 and first resistor 50 acting as a substantially constant current source to supply a current through the second stage comprising the second transistor 62 and the second resistor 70. We can examine the operation of the circuit by comparing the voltages VA, VB and VC at the nodes labeled A, B and C for temperatures $T_1$ and temperature $T_1$+dT.

At temperature $T_1$, we see that that following relationships can hold:

$$VA=V_{gs2}(I)$$

$$VB=VA+IR_2$$

$$VC=VB+IR_1 \text{ where } IR_1=-V_{gs1}(I)$$

so at $T_1$ $$V_{out}(T_1)=V_{gs2}(I)+IR_2-V_{gs1}(I).$$

However, we can also rewrite $IR_2$ to eliminate I, since the current I is equal to the voltage across $R_1$ divided by the value of $R_1$. The voltage across $R_1$ is simply $V_{gs1}(I)$, so $$Vout(T_1) = V_{gs2}(I) - V_{gs1}(I)\frac{R_2}{R_1} - V_{gs1}(I)$$

$$Vout(T_1) = V_{gs2}(I) - V_{gs1}(I)\frac{(R_1+R_2)}{R_1}$$

If a temperature change dT occurs, then at $T_1$+dT $$VA = V_{gs2}(I) - K_2dT$$

$$VB = VA + IR_2$$

$$VC = VB - V_{gs1}(I) + K_1dT$$

so

-continued $$V_{out}(T_1+dt) = V_{gs2}(I) - K_2dt - (V_{gs1}(I) + K_1dt)\frac{R_1+R_2}{R_1}$$

Accordingly, the change in output voltage is:

$$\left(K_1\frac{(R_1+R_2)}{R_1} - K_2\right)dt$$

and hence $$\frac{dVout}{dt} = K_1\frac{(R_1+R_2)}{R_1} - K_2$$

Thus, the first resistor 50 and the second resistor 70 allow the temperature coefficient of the first transistor 42 to be increased by a gain of $(R_1+R_2)/R_1$.

Thus, the arrangement shown in FIG. 4 works in substantially the same way as that shown in FIG. 3, except that the inclusion of the second resistor 70 gives a circuit designer the option to vary the temperature coefficient.

Figure 5:
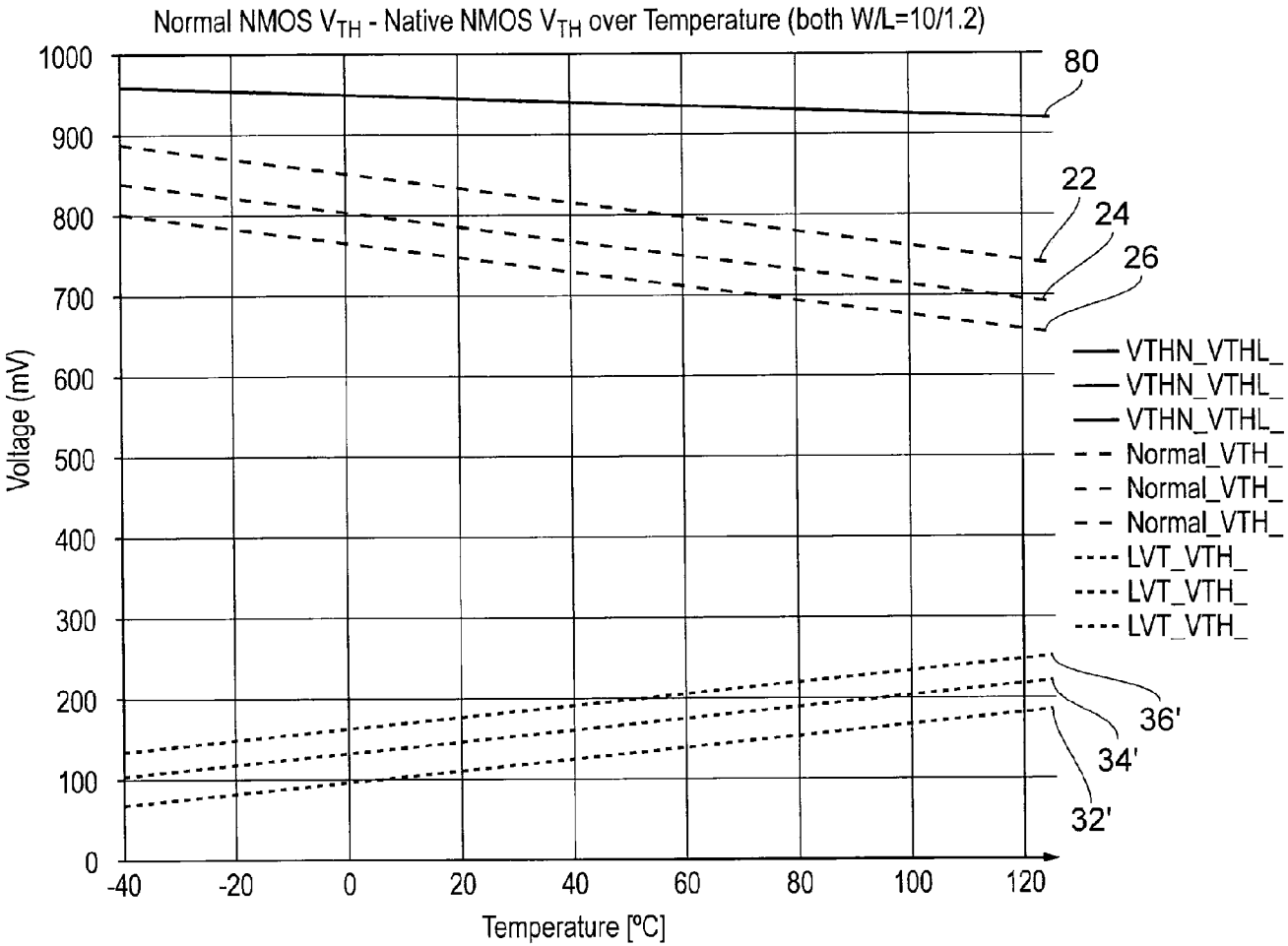
FIG. 5 shows a plot of a negated threshold voltage versus temperature for the first stage of a voltage generator as shown in FIG. 3, the threshold voltage versus temperature for the second stage of the voltage generator shown in FIG. 3, together with their sum (as shown in the graph) illustrating the stability of the output voltage with respect to temperature and process variation.

From the analysis given with respect to FIGS. 3 and 4, it can be seen that the function of the first stage 40 is to change the negative temperature coefficient of threshold voltage $V_{TH1}$ with respect to temperature around the first transistor 42 to effectively a positive temperature coefficient. This, is shown in FIG. 5 where the variation of threshold voltage $V_{TH2}$ with respect to temperature for the normal NMOS transistor is represented by lines 22, 24 and 26 corresponding to those presented in FIG. 2, whereas the negated change in threshold voltage $V_{TH}$ versus temperature for the native NMOS transistor is represented by lines 32', 34' and 36' representing the negated versions of lines 32, 34 and 36. The sum of the temperature coefficients represented by lines 22 and 32' is represented by line 80 which shows the change of output voltage of the reference voltage generator with respect to temperature. It can be seen that line 80 has a relatively modest gradient, and that the output voltage only changes by around 10 mV over a 100° C. range. This is significantly less than the changes in threshold voltage versus temperature for either of the transistors 42 or 62 in the circuits of FIGS. 3 and 4. A change of around 10 mV over 100 degrees Centigrade compares favourably with a corresponding change of around 70 mV from the native NMOS device or around 90 mV from the normal NMOS transistor. Thus the combined temperature coefficient is less than one fifth (20%) of either of the transistors of the first or second stages, and typically is nearer to one seventh (14-15%) of the coefficient of the native device and one ninth (11%) of that of the normal device.

The reference voltage generators described herein provide a self starting voltage reference having reasonable performance with respect to temperature changes. The voltage reference temperature coefficient of the output voltage can be tailored by the choice of a resistance value of the second resistor 70.

Figure 6:
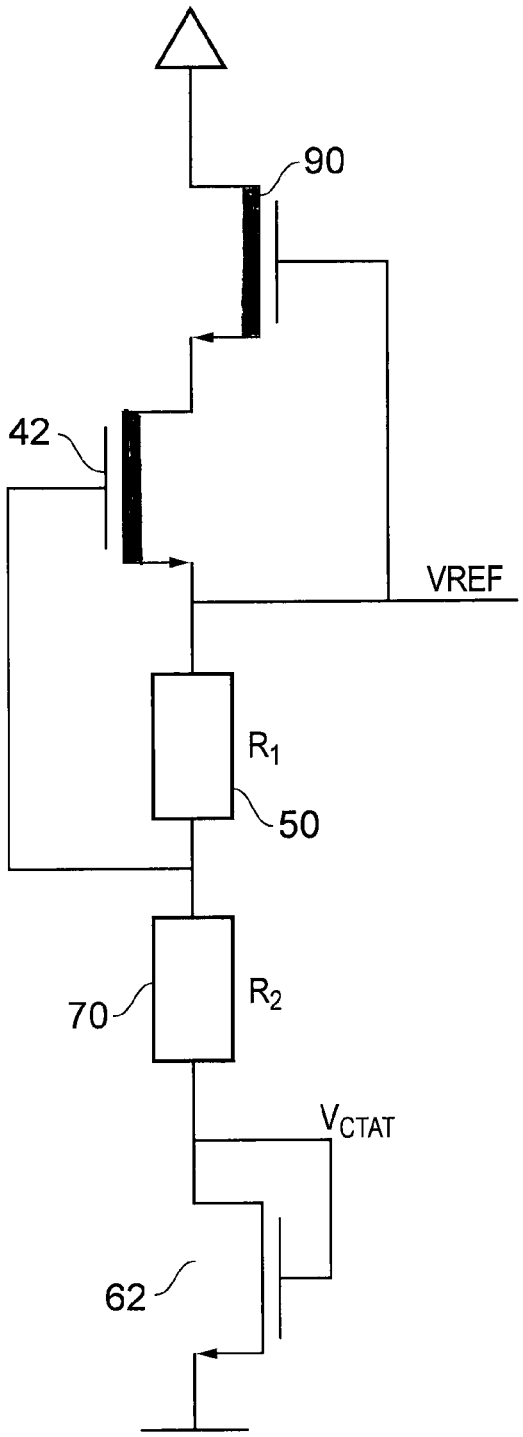
FIG. 6 shows a further modification to the arrangement shown in FIG. 4 with the addition of a cascode transistor.

FIG. 6 shows a further modification to the circuit of FIG. 4 where a cascode transistor, generally indicated 90, is disposed between the drain of the first transistor 42 and the power supply 30. The cascode transistor 90 has its source connected to the drain of the transistor 42 and its drain connected to the power supply. The gate of the cascode transistor 90 is connected to Vref. The cascode transistor 90 stabilizes the reference voltage Vref such that it becomes more stable with respect to changes of the supply voltage. The transistor 90 is similar to the transistor 42 in that it can conduct when its gate voltage is approximately the same as its source voltage, thereby ensuring that the circuit can remain self starting. Thus, the cascode transistor 90 may be a native transistor or a depletion mode transistor.

Figure 7:
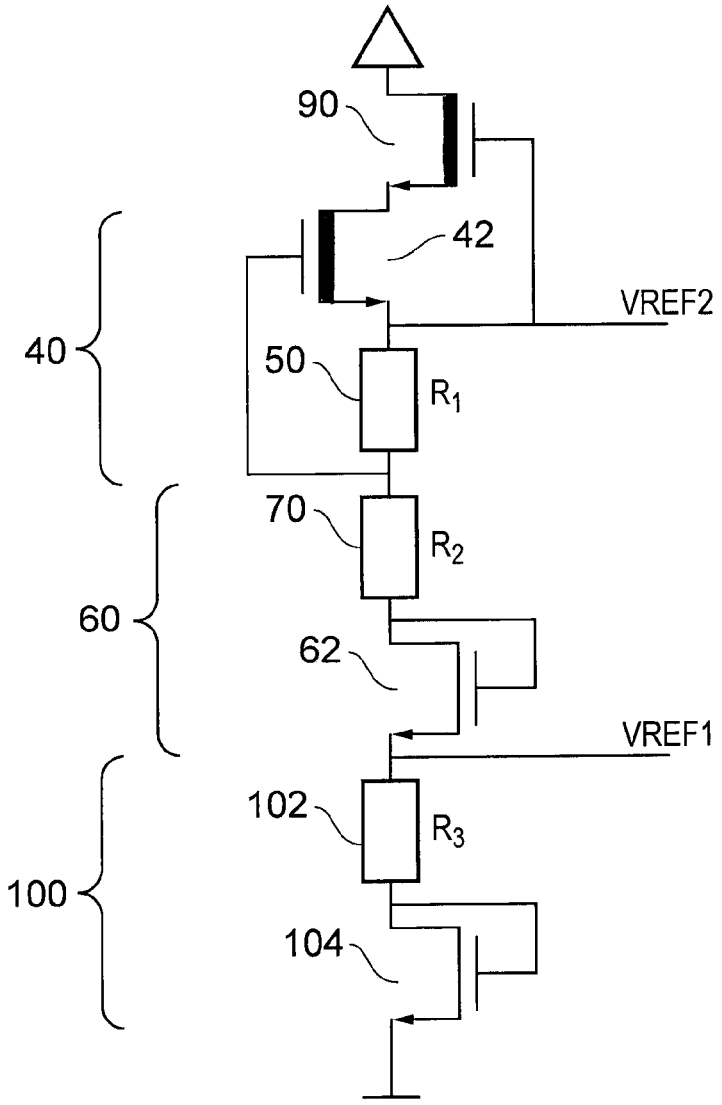
FIG. 7 shows a further arrangement in which a voltage generator comprises two series connected second stages.

FIG. 7 shows a further modification where a third stage, generally indicated 100, is provided between the second stage 60 and a zero voltage line 32. The third stage 100 may simply comprise a third resistor 102 having a resistance $R_3$ such that $Vref_1$ is a product of I and $R_3$, and $Vref_2$ becomes referenced to $Vref_1$ by the way described hereinbefore with respect to FIG. 4. Alternatively, the third stage 100 may comprise a third resistor 102 in combination with a diode connected transistor 104 as illustrated, or it could merely be a further diode connected transistor. In general, the resistance $R_2$ of the second resistor 70 and/or the resistance $R_3$ of the third resistor 102 may be 0 ohm or greater than 0 ohm.

Figure 8:
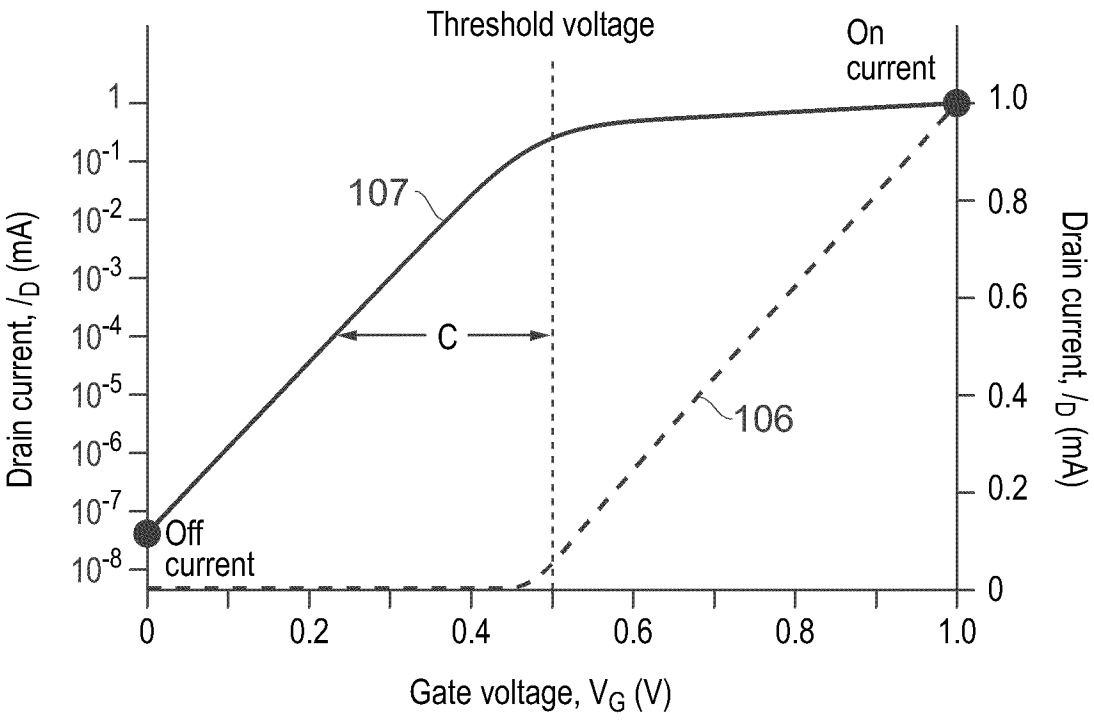
FIG. 8 is a plot of drain current versus gate voltage for a normal NMOS FET, showing the drain current on linear and logarithmic scales.

The reference voltage generator can have exceedingly low current consumption as both the first and second transistors 42 and 62 (or indeed all of the transistors) can be operating at gate voltages at or below their threshold voltage $V_{TH}$. This can sometimes be overlooked and will be explained with respect to FIG. 8. The person skilled in the art is often presented with a gate voltage versus drain current plot where the drain current is presented on a linear scale. This is shown in FIG. 8 by the broken line 106 and the right hand scale. For the device illustrated in FIG. 8, the threshold voltage is +0.5 volts and when the current is shown on a linear scale it looks as if the device remains substantially non-conducting until the threshold voltage is reached. Thereafter the drain current rises substantially linearly. However, the same data can also be presented on a logarithmic scale as indicated by the solid line 107 and the logarithmic plot of drain current presented on the left hand axis. This demonstrates that, for this device, currents of micro-amps or tenths of micro-amps are conducted at gate voltages of between 0.2 and 0.3 volts, which is less than the notional threshold voltage of 0.5 volts.

For the native transistor implementation of the first transistor 42, the resistance value of the first resistor 50 may be set to give a desired operating current through the reference voltage generator when the first transistor has a gate voltage of −200 mV or so (and indeed it could be between −300 mV and −100 mV and these values are not limiting) with respect to the source voltage of the first transistor 42. It also follows that the second transistor 62 can be operating at a $V_{gs}$ below its threshold voltage, or indeed above it. Typically the native transistor is operating with a $V_{gs1} \approx V_{TH1}$.

FIG. 8 also helps demonstrate that the enhancement mode (normal) transistor is able to conduct when its gate-source voltage is below its threshold voltage and that for a given device current, the gate voltage can be represented as the threshold voltage $V_{TH}$ plus an offset C. Thus, for a device current of $10^{-7}$ amps, the gate voltage acquired by the normal device shown in FIG. 8 is approximately 0.25 volts, which can be regarded as a threshold voltage $V_{TH}$ of 0.5 volts plus an offset C of −0.25 volts. Thus, it follows that changes to the threshold voltage $V_{TH}$ as a result of temperature would give rise to a change in current through the device or, where the device operates in a substantially constant current mode as is the case here, changes in temperature would give rise to a change in the gate voltage at a substantially constant current. This indicates that, to a first approximation, we need only partially cancel the changes in threshold voltage $V_{TH}$ with respect to temperature in order to improve the performance of the reference voltage generator compared to that of a single transistor. Furthermore, as noted before, process variations are common in the field of semiconductor fabrication component parameters may vary by as much as 20% from one wafer to the next. The reference voltage generator circuit described herein has the advantage that variations in the first transistor 42 can be substantially matched by variations in the second transistor 62, and since these transistors are combined in an opposing manner it gives rise to a circuit which can be robust against manufacturing variations.

The variations in temperature coefficient between the first and second transistors 42 and 62 can be modified such that the first voltage reference $V_1$ and the second voltage reference $V_2$ can be added in a proportion to substantially cancel their temperature coefficients. This can be achieved by varying the relative values of the resistors, such as the first resistor 50 and/or the second resistor 70, and/or the relative dimensions of the transistors, such as the first transistor 42 and/or the second transistor 62. Thus, in the arrangement of FIG. 4, increasing the value of the second resistor 70 can increase the contribution of the positive temperature coefficient to the output voltage Vref.

Figure 9:
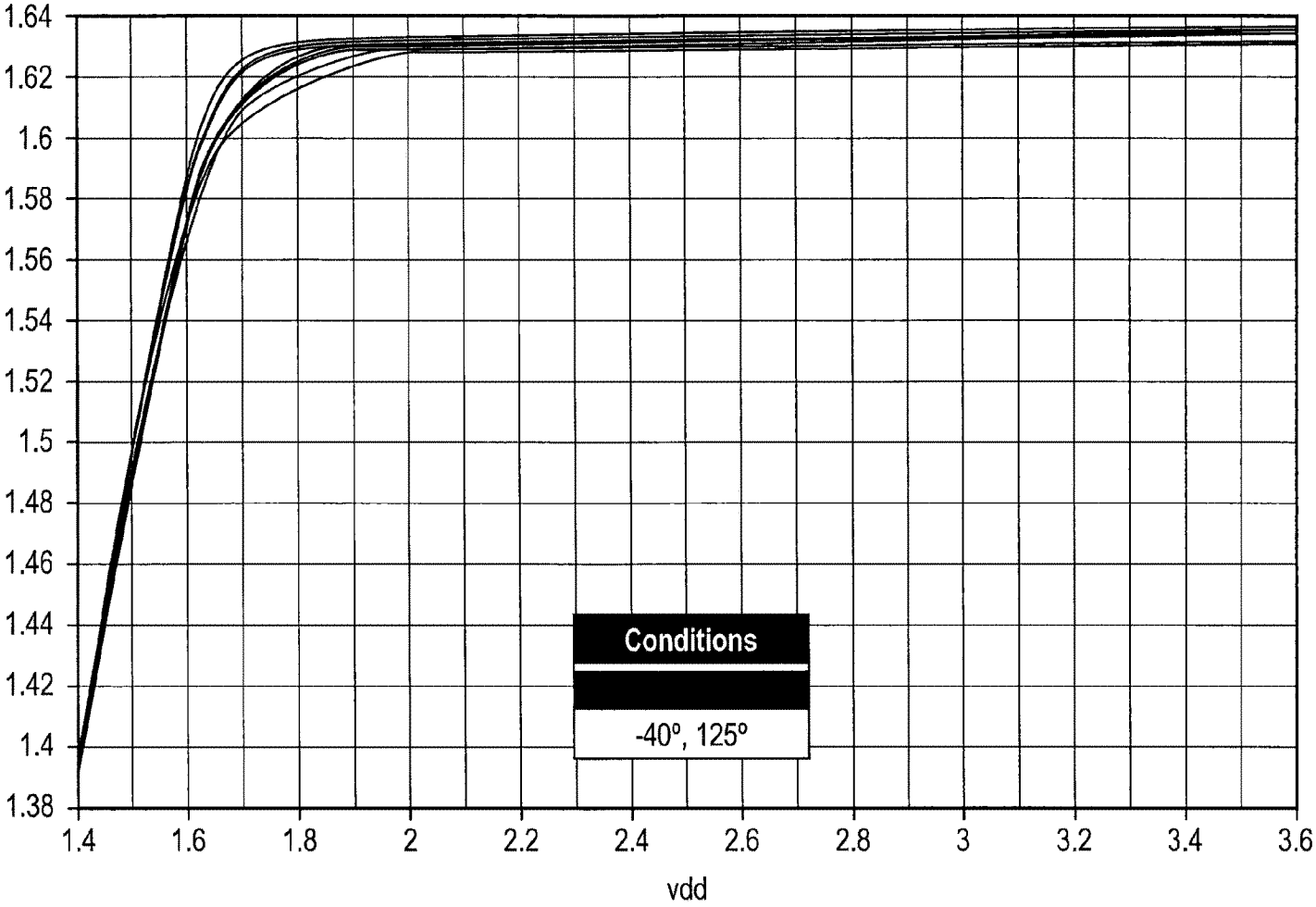
FIG. 9 is a graph showing plots of output voltage versus supply voltage for a plurality of versions of the circuit shown in FIG. 4, where the circuits are subject to process variation during manufacture, and are randomly selected to operate over a temperature range of −40° to +125° C.

FIG. 9 shows a plot of output voltage versus supply voltage for seven devices including reference voltage generators operated between temperature ranges of between −40° and +125° C. It can be seen that in this example the output voltage becomes stabilized at substantially 1.63 volts once the supply voltage reached 2 volts for substantially the entirety of the temperature range between −40° and +125° C.

Typically in low power applications the values of the resistors used are relatively high, around 1 to 2 MΩ, for example.

The fact that the reference voltage generator is self starting, and can operate reliably with a relatively low supply voltage, also makes it suitable for use as an input circuit to power on reset circuit. When a logic circuit is initially powered up, the gates therein may arbitrarily set themselves to any logic state, and this may depend on random fluctuations within the system during the power-up process. In order to overcome the problem of such a logic circuit powering up in an undefined state, it is known to issue a reset command to the circuit as soon as the voltage supply has become sufficiently established to ensure that the circuit can operate reliably. The reset command resets the circuit to a known initial condition. The circuit used herein has been described in terms of NMOS devices so as to provide a voltage difference with respect to 0 volts or $V_{SS}$. However the equivalent circuit can be implemented in PMOS so as to give a circuit providing an output voltage referenced with respect to $V_{DD}$ or the positive supply. The reference voltage generators described herein could be used to provide a reference to one input of a comparator. The comparator can then monitor the voltage across a further transistor, in order to determine when the supply had become sufficiently established.

Figure 10A:
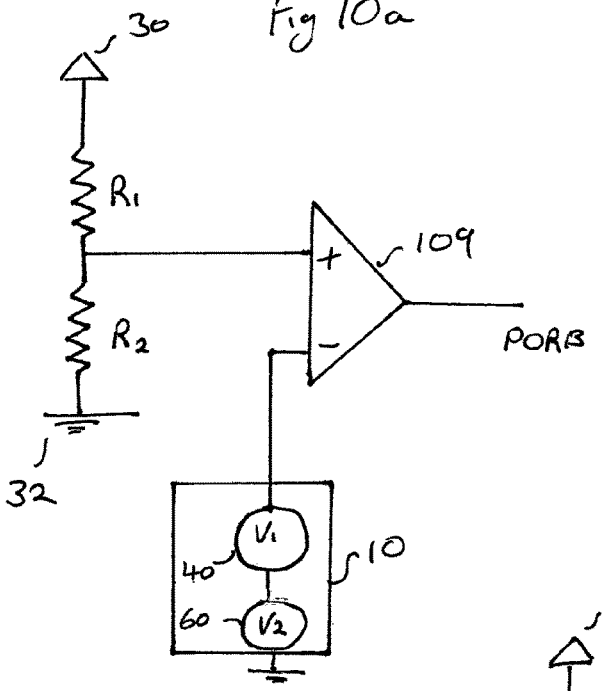
FIGS. 10*a* to 10*c* are schematic diagrams of various configurations of power up reset signal generator circuits.
Figure 10B:
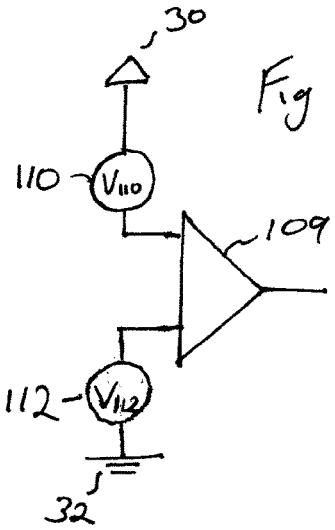
Figure 10C:
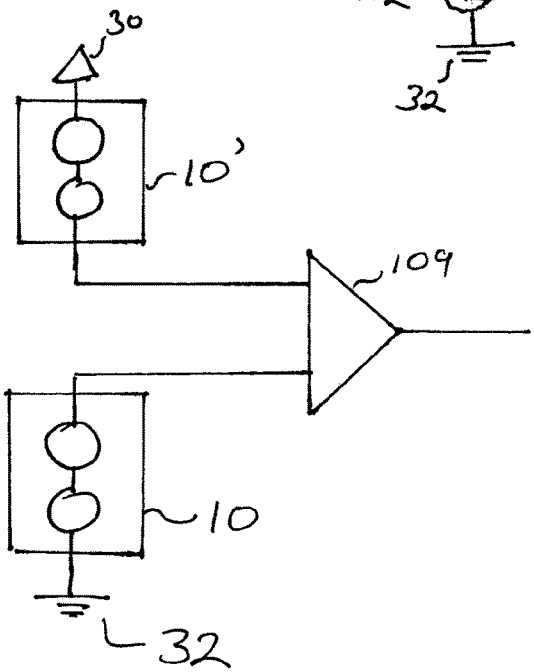

FIGS. 10*a* to 10*c* schematically illustrate three configurations of comparator based power up reset signal generator circuits. Each circuit includes a comparator 109 having first and second inputs. In general a comparator output goes 'high' when the voltage at its non-inverting or "+" input exceeds the voltage at its inverting or "−" input. As a consequence, the circuit designer can choose how to connect components, such as voltage generators, to the comparator to determine whether the comparator output will go high or low, as appropriate, after the power supply voltage has become established.

In the arrangement shown in FIG. 10*a*,a reference voltage generator 10, for example, of the type described hereinbefore with respect to FIG. 3, 4, 6 or 7, uses first and second stages 40 and 60 to generate a reference voltage with a desirable temperature coefficient. This reference may be connected to the "−" input of the comparator 109. Resistors $R_1$ and $R_2$ may be arranged in series between the positive supply 30 and the local 0V supply 32, so as to form a potential divider connected to the "+" input of the comparator 109. By appropriate selection of the ratio of the resistance of the resistors $R_1$ and $R_2$, the circuit designer can ensure that once the voltage generator 10 has stabilized, the output of the comparator 109 can be held low until the supply voltage reaches an appropriate threshold. This can cause the comparator output to go high (or low for an active low comparator output).

FIG. 10*b* represents an arrangement in which the first and second voltage sources 110 and 112 provide input voltages to a comparator 109. The voltage source 110 provides a voltage $V_{110}$ which is referenced with respect to the positive power supply rail 30. Such a voltage reference can be generated by a normal NMOS FET that functions as a voltage follower to the supply rail 30, in association with a suitable current sink. The voltage reference 112 providing a voltage $V_{112}$ may be a reference voltage generator as described hereinbefore.

FIG. 10*c* shows a further variation, in which two voltage reference generators of the type described hereinbefore are used. The first voltage reference generator may be as described with respect to FIG. 3, 4, 6 or 7 so as to generate a reference with respect to the 0V line 32. The second voltage reference, designated 10' is similar to the voltage reference 10, but is swapped around such that, taking the FIG. 3 embodiment as an example, the transistors are p-type devices, the source of the second transistor 62 is connected to the positive supply 30 and the drain of the first transistor 42 is connected to the 0V supply 32. As a result, this circuit generates as output referenced to the positive supply voltage. The voltages from the first and second voltage generators 10 and 10' are supplied to appropriate inputs of the comparator 109.

Figure 11:
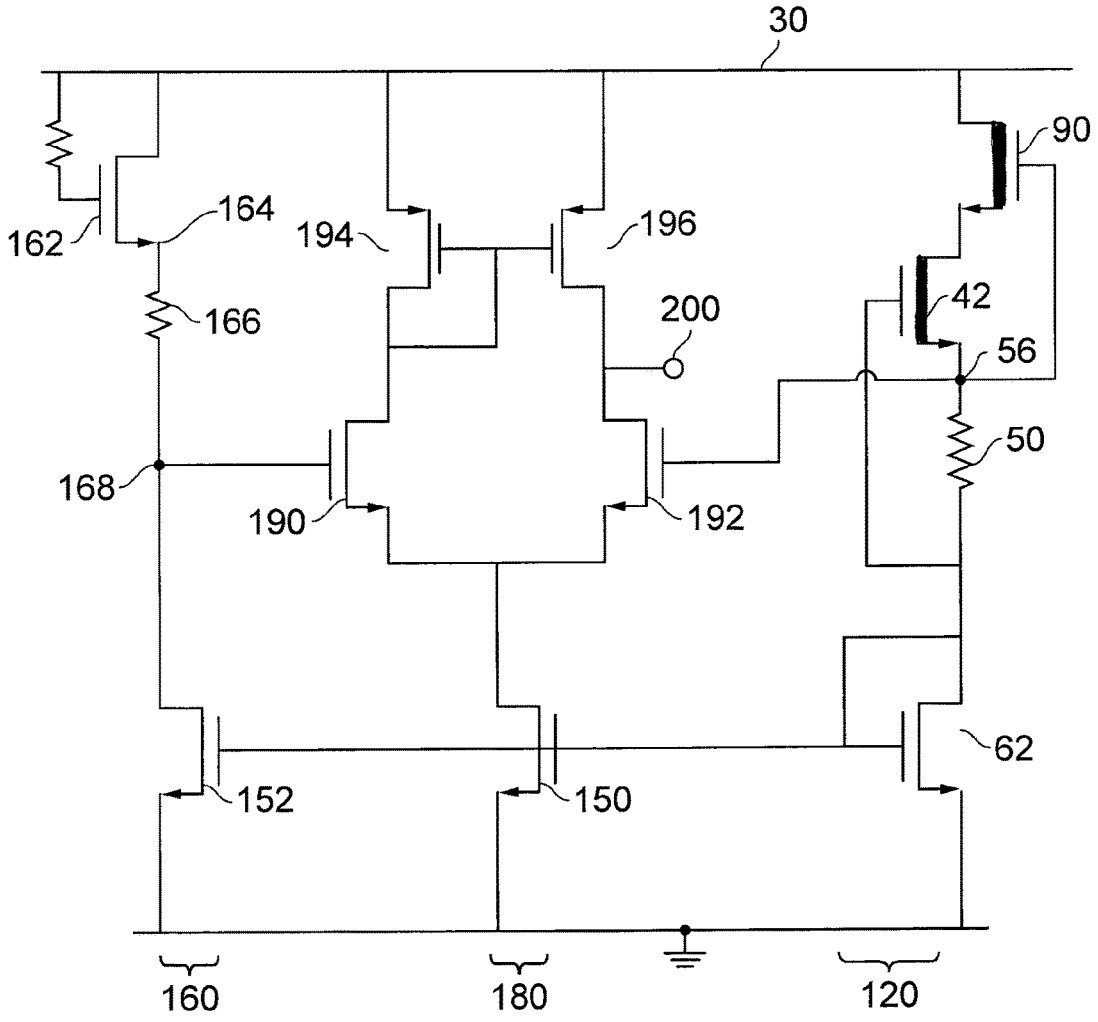
FIG. 11 is a circuit diagram showing part of a power up reset generator in greater detail.

FIG. 11 shows a combination of a reference voltage generator 120 and a comparator 180 which may be used in part of a power up reset circuit. Although the power up reset circuit shown in FIG. 11 includes one example reference voltage generator, it will be understood that the power up reset circuit can include any of the reference voltage generators described herein. The reference voltage generator is designated 120 and has the circuit topology described herein with respect to FIG. 3, but with the inclusion of the cascode transistor 90 as described with respect to FIG. 6, although the circuit of FIG. 6 could alternatively have been used. Thus, the voltage reference generator 120 comprises a first stage formed of a native MOSFET transistor 42 whose drain is connected to the source of the cascode transistor 90. A depletion mode FET may be used in place of the native MOSFET. The drain of the cascode transistor 90 is connected to a positive supply rail 30 whose voltage is to be monitored. The source of the native transistor 42 is connected to the drain of a diode-connected second transistor 62 by way of the first resistor 50. Thus, as described hereinbefore, the first transistor 42 and the first resistor 50 act to define a current generator, with the current being passed through the diode-connected FET 62. The diode connected FET 62 also acts as a master transistor (or input transistor) in current mirror including slave or output transistor 150 of the comparator 180, which provides current to the comparator 180, and slave or output transistor 152 which controls the current passing through a measurement limb 160 of the power up reset circuit. The sources of the transistors 150 and 152 can be connected to a ground potential. The measurement limb 160 comprises a further (normal) NMOS transistor 162 in a diode connected configuration. The voltage at the source 164 of transistor 162 is approximately equal to the supply voltage 30, which can be supplied directly to the gate of the transistor 162, less the gate source voltage required to support the current flow through the transistor 162 as set by the current minor transistor 152. A resistor 166 is provided in series between the source of the transistor 162 and the drain of the current minor transistor 152 in order to provide a further voltage drop of known size as the current in the resistor 166 is set by transistor 152. The resistor 166 may have a relatively large resistance value of, for example, several MΩ. The voltage at a node 168 between the resistor 166 and the current mirror slave transistor 152 forms a first input to the comparator 180.

The voltage formed at the node 56 between the native transistor 42 of the reference voltage generator and the first resistor 50 forms a second input to the comparator 180.

The comparator 180 is of a well known configuration (and is only described by way of example), comprising first and second transistors 190 and 192 arranged in a differential pair and having their sources commonly connected to a current sink formed by the transistor 150. The drains of the transistors 190 and 192 are connected to an active load formed by a first PMOS transistor 194 and a second PMOS transistor 196. The first PMOS transistor 194 is in series current flow communication with the drain of the NMOS FET 190, and the second PMOS transistor 196 is in series current flow communication with the drain of the NMOS transistor 192. The gates of the transistors 194 and 196 are connected together and to the drain of the NMOS transistor 190. A node formed between the drain of the PMOS transistor 196 and the drain of the NMOS transistor 192 forms an output node 200 of the power on reset circuit. The comparator 180 shown herein does not include hysteresis, but hysteretic operation can be added by returning some of the output signal back to the input side 168 or by switching on the further transistor in parallel with the second transistor 62 in response to the output voltage at the node 200.

In operation, as the supply voltage 30 rises from zero to its normal operating voltage, which for the purposes of this example may be assumed to be about 3 volts, a current immediately starts to flow through the reference voltage generator 120 which has the effect of establishing the operation of the current mirrors 150 and 152. As the voltage continues to rise, the voltage at the node 56 and hence that presented to transistor 192 also continues to rise until such time as sufficient voltage headroom has been established within the circuit for the voltage reference generator to stabilize at its nominal output voltage of around 0.8 volts in this example (and fabrication process). Meanwhile, turning to the measurement limb 160, the voltage at the node 168 remains close to zero volts because the transistor 162 has not started to conduct significantly because the voltage across it has not risen sufficiently for it to start its voltage follower operation. However, as the voltage increases further, the transistor 162 can now switch on and the voltage at node 168 rises to correspond to the voltage on the supply line 30 less the gate source voltage across the transistor 162 for the current I defined by the current sink 152 and less the product of the voltage drop across the resistor 166 defined by the product of the current I and the resistance of the resistor 166. As the voltage on the supply line 30 increases, there becomes a point in which the gate voltage for the transistor 190 exceeds the gate voltage of the transistor 192 and the comparator operates so as to transition the voltage at the node 200 from a low value to a high value. This transition can be used to drive a monostable in order to assert a reset pulse to logic circuits supplied by the supply rail 30 so as to reset them to a known condition.

Up to now, series connected stages have been described, but other variations are possible. In the preceding discussion in relation to the series connected circuit of FIG. 3 it was noted that we could equate the gate source voltage of the first (native) transistor to the current flowing through it since $IR_1=-V_{gs1}(I)$.

The output voltage Vref for the arrangement shown in FIG. 3 was expressed as $Vref=V_{gs2}(I)+R_1=V_{gs2}-V_{gs1}$ It was also noted that a change in temperature, for example an increase would result in the voltage across the second transistor dropping, but the feedback loop formed by the first transistor and the first resistor would synthesize a voltage increase, and that these effects could be used to counteract each other. In the circuit arrangement of FIG. 4, the second resistor 70 having a resistance $R_2$ was introduced to allow the temperature coefficient of the first stage to be gained up by the ratio of $R_2$ and $R_1$.

Figure 12:
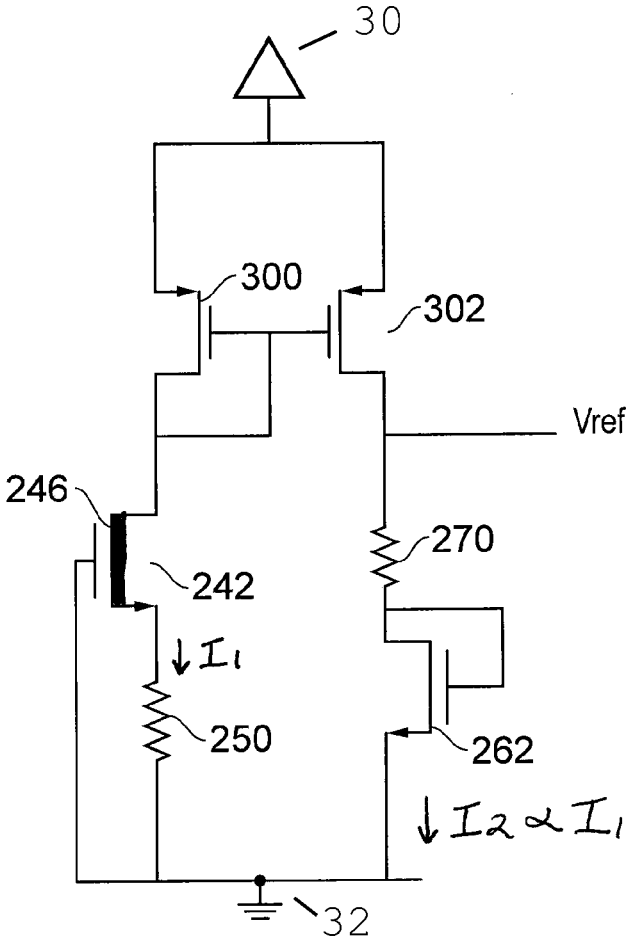
FIG. 12 is a circuit diagram of a further embodiment of a voltage generator.

FIG. 12 shows an embodiment of a voltage reference generator which still uses these principles of operation, but where the first and second stages are coupled by a current mirror instead of being directly connected to each other.

As shown in FIG. 12 the first transistor, now designated 242, has a first node of the first resistor, now designated 250, connected to its source. A gate 246 of the first transistor 242 is connected to a second node of the first resistor 250. The second node of the second resistor is in current flow communication with a local ground 32, either directly as shown in FIG. 12, or by way of intermediate components if desired (such as resistors, transistors or even the second stage configurations as shown in FIGS. 3 and 4).

As before, the first (native) transistor 242 and the first resistor 250 act to form a self starting current source. However, rather than this current passing directly from the second node of the first resistor 250 to the second stage, the current flowing through the first transistor 242 and first resistor 250 is transformed by a current minor which in this example is connected to the drain of the first transistor 242 and comprises transistors 300 and 302 connected in a well known current mirror configuration. The first resistor 250 is in series between a ground potential 32 and the source of the first transistor 242. The transistor 300 is connected to the drain of the first transistor 242 and acts as the master or input transistor in the current mirror. Consequently, the current $I_2$ flowing at the drain of the transistor 302 is proportional to the current $I_1$ flowing in the first resistor 250, subject to any current scaling factor ($b_1$) that the current mirror designer has introduced, so $I_2=b_1I_1$.

The second stage still comprises a second field effect transistor, now designated 262 in a diode connected configuration (or it may contain a diode or a diode connected bipolar junction transistor). A second resistor now designated 270 and having a resistance $R_2$ is connected between the source of the second transistor 262 and the drain of the current mirror transistor 302. The source of the second transistor 262 is connected to a ground potential. The output voltage Vref can be taken from the connection between the second resistor 270 and the current mirror.

It can be seen that $$Vref=V_{gs2}(I_2)+IR_2$$

$$I_2=bI_1$$

and $$I_1=-V_{gs1}/R_1$$

So we can rewrite Vref as $$Vref=V_{gs2}(I)-(V_{gs1}(I)*b*R_2/R_1)$$

where is should be remembered that $V_{gs1}(I)$ is a negative number.

It can be seen that a small increase in temperature will cause a drop in $V_{gs2}$, but similarly it also cause a reduction in the magnitude of $V_{gs1}$. Thus, the first stage passes more current so although the voltage dropped across the second transistor is reduced, the voltage dropped across the second resistor increases. These effects can be used to substantially cancel each other out to provide a relatively temperature stable voltage source.

In the embodiments described so far, the first transistor 42 or 242 has had a series resistor 50 or 250 connected to its source. It is an intrinsic property of a resistor that it has a resistance, but other components can also offer a resistance, although the value may not be so well defined.

Figure 13:
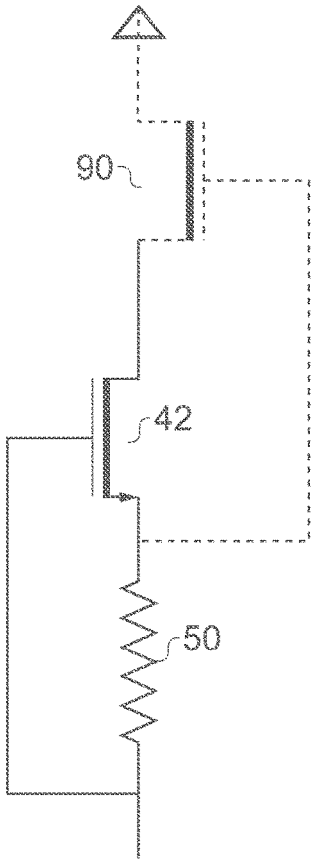
FIG. 13 schematically illustrates just the first stage of a reference voltage generator of the type shown in FIG. 3.

FIG. 13 shows the first stage 40 from FIG. 3. This stage can be associated with a cascode transistor 90 as an optional addition to the circuit and as represented by being drawn using broken lines.

Figure 14:
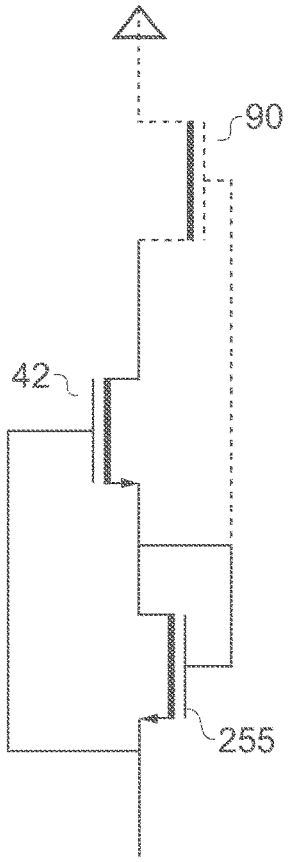
FIG. 14 shows a modification to the first stage shown in FIG. 13, where the explicit resistor has been replaced by a transistor configured to have a suitably high on state resistance.

The resistor 50 provides a resistance R, but as shown in FIG. 14, a functionally equivalent circuit can be achieved by replacing the resistor 50 by a native FET 255 acting to provide a diode connected FET whose dimensions or doping may be selected to give a relatively high $R_{on}$, and which also gives an increased effective temperature coefficient $K_1$ for the first transistor 42 which is a combination of the coefficients of the transistors 255 and 42.

Figure 15:
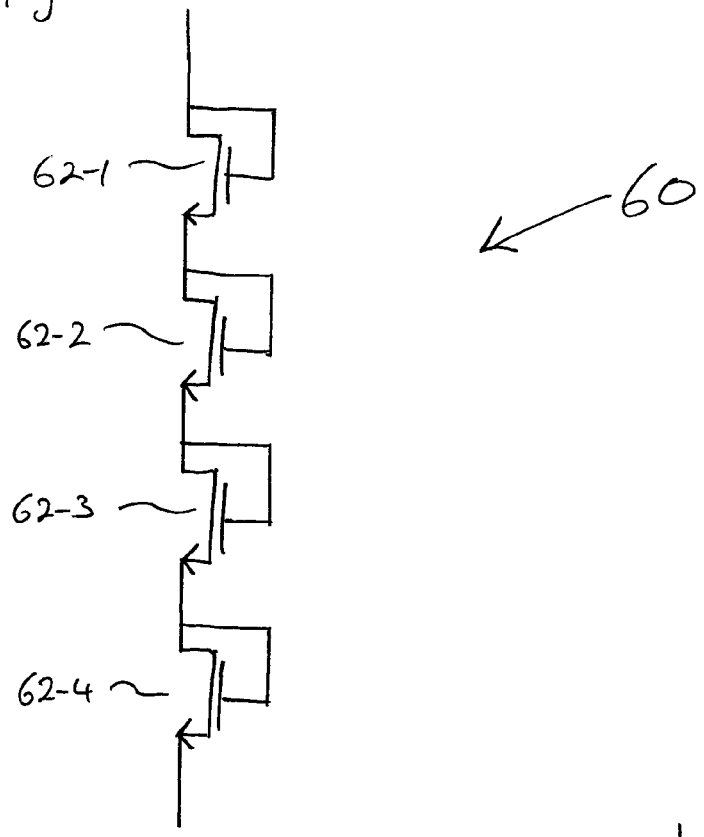
FIG. 15 shows a modification to the second stage, for example as shown in FIG. 3, where a plurality of transistors are provided in place of the single second stage transistor.

The voltage contribution from each stage may also be varied. For example, the second stage 60 in FIG. 3 comprised a diode connected transistor giving a voltage drop of $V_{gs2}(I)$. Multiple transistors may be provided. N transistors connected in series would give a voltage drop of $NV_{gs2}(I)$, in which N is a positive integer. Such an arrangement is shown in FIG. 15 for N=4 such that four diode connected transistors 62-1 to 62-4 are arranged in series.

The voltage gain around the first stage 40 can also be varied. We have already shown that $$V_{out} = V_{gs2} - V_{gs1}\frac{R_1 + R_2}{R_1}$$

Figure 16:
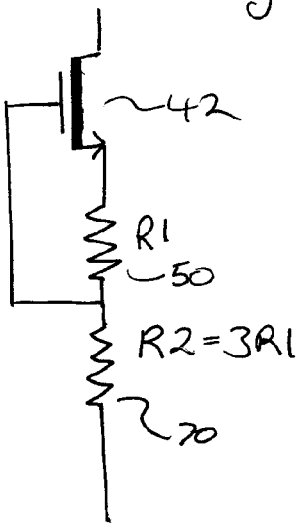
FIG. 16, illustrates part of FIG. 4 as an example of varying the contribution of the first stage.

Therefore, the arrangement shown in FIG. 16, which represents just part of the circuit shown in FIG. 4 and where $R_2=3R_1$, provides a gain of $-4V_{gsn}$ where $V_{gsn}$ is the gate to source voltage for the native transistor 42.

Figure 17:
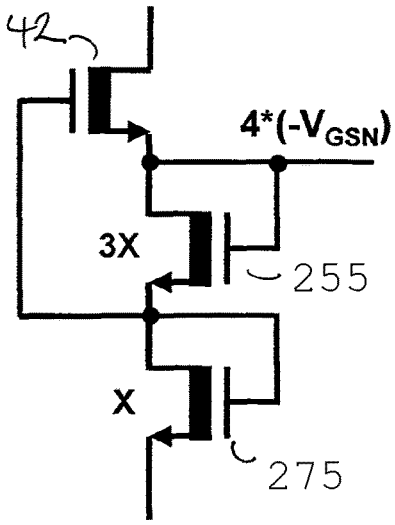
FIG. 17 shows a variation to FIG. 16 where the resistors have been replaced by transistors configured to have a suitable "on" resistance.

We have also noted that resistors can be replaced by other components exhibiting resistance. Accordingly, a different resistive element can be used in place of a resistor, such as the first resistor 50 and/or the second resistor 70. In a variation both the first resistor 50 and the second resistor 70 can be replaced by diode connected native FETs arranged to have desired 'on' state resistances within the circuit. Such an arrangement is shown in FIG. 17 where the first resistance is replaced by a FET 255 the second resistance is replaced by a FET 275 and the aspect ratios of the devices or doping is selected such that they have different resistances, for example 3 to 1 as shown in FIG. 17 to give a contribution from the first transistor 42 of $-4V_{gs1}$. Thus, in the example FET 255 is three times as wide as FET 275 so that it has one third of the resistance of FET 275.

Figure 18:
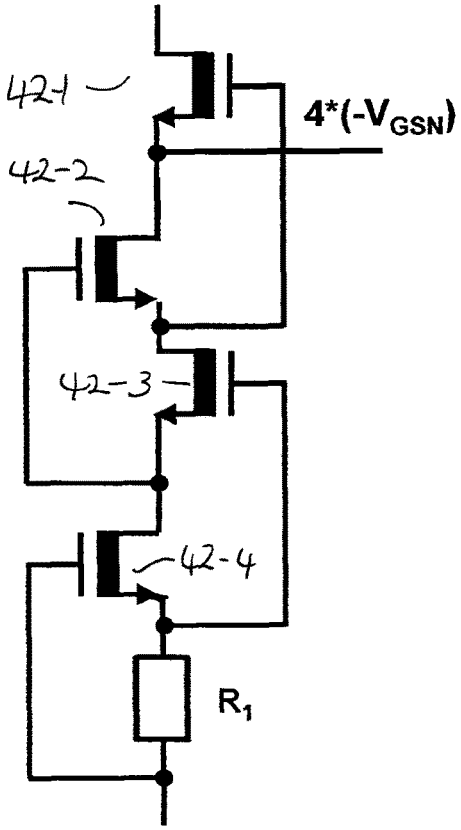
FIG. 18 shows a variation of the implementation of the first transistor that can be applied to any of the embodiments described herein, where a single native or depletion mode transistor is replaced by several native transistors in a stacked configuration.

In a further variation, as shown in FIG. 18, the first (native) transistor 42 may be split into a plurality of devices 42-1 to 42-4 connected as shown, so that any given transistor has an effective source resistance formed by the next series connected transistor or by the resistor R1 (which can itself be replaced by a diode connected native transistor). The configuration shown, having four transistors, gives a gain of 4 so the 'first' transistor's contribution is $-4V_{gs1}(I)$.

Figure 19:
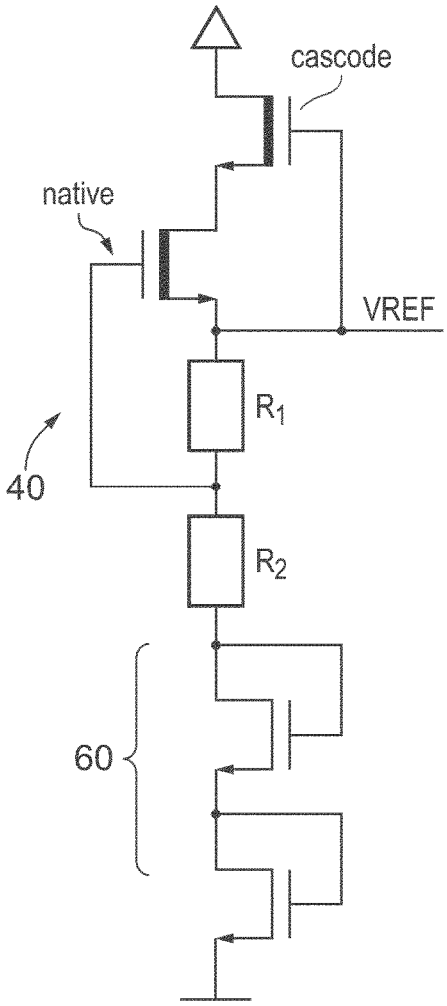
FIG. 19 shows a first stage of the type shown in FIG. 16 in combination with a second stage as described with respect to FIG. 15.

The additional variations described here can be used in combination. Thus FIG. 19 shows a first stage 40 having a gain determined by $R_1$ and $R_2$ as shown in FIG. 16, and the second stage has a plurality (in this example 2) of diode connected transistors as described with respect to FIG. 15. Therefore $$V_{ref} = 2V_{gs2} - \left(1 + \frac{R_2}{R_1}\right)V_{gs1}$$

Figure 20:
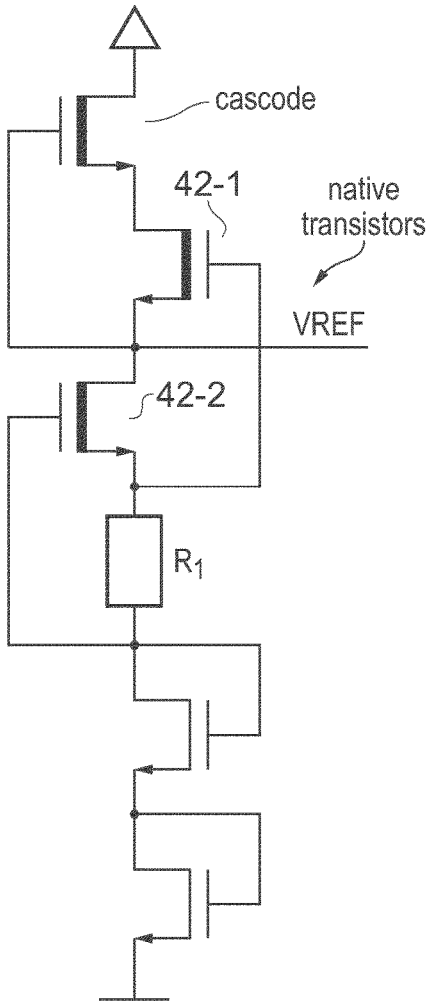
FIG. 20 shows an embodiment having multiple native transistors in the first stage and a plurality of transistors in the second stage.

In FIG. 20 the number of transistors in each of the first and second stages has been selected as two so as to give $$V_{ref}=2(V_{gs2}-V_{gs1})$$

Figure 21:
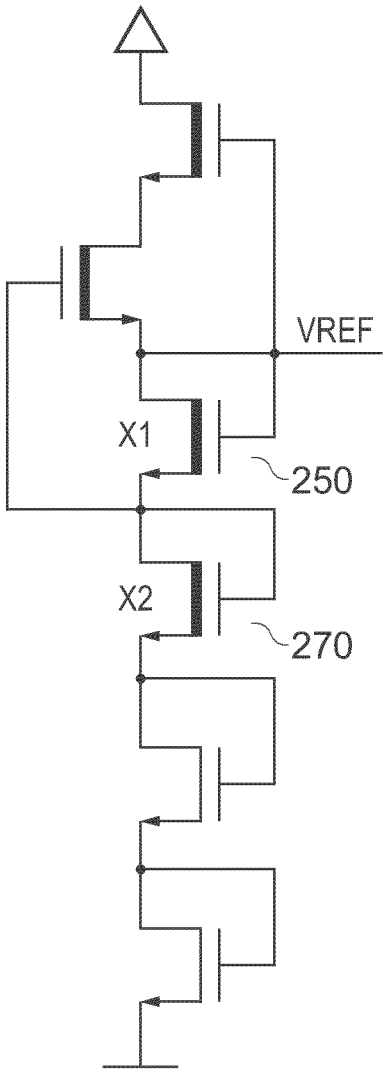
FIG. 21 repeats the circuit of FIG. 19, but the explicit resistors R1 and R2 have been replaced by transistors arranged to have suitably high "on" resistance values.
Figure 22:
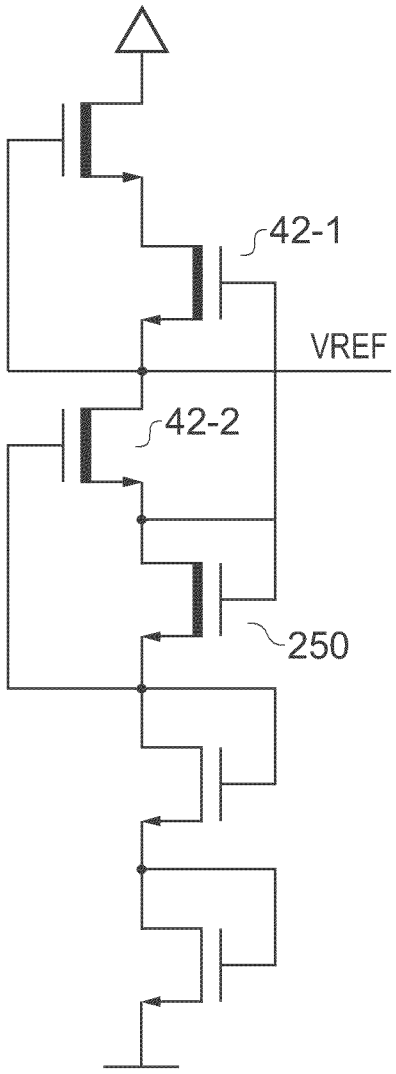
FIG. 22 repeats the circuit of FIG. 20, but with the explicit resistors being replaced by a transistor configured to exhibit a suitable resistance value.

FIGS. 21 and 22 show circuits that are equivalent to those shown in FIGS. 19 and 20, respectively, but with the explicit resistors being replaced with transistors 255 and 275. The transistors may be native or depletion mode transistors.

Figure 23:
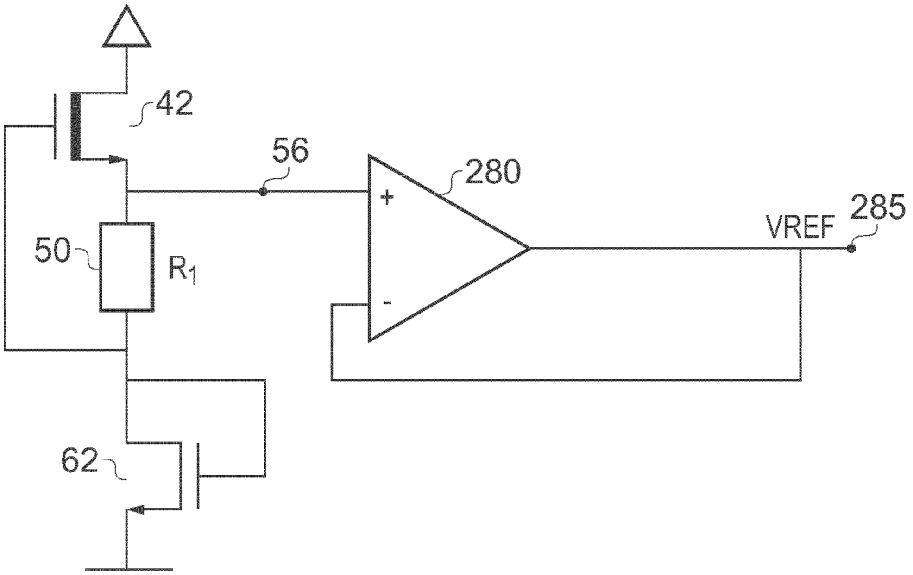
FIG. 23 illustrates a voltage reference in combination with a buffer.
Figure 24:
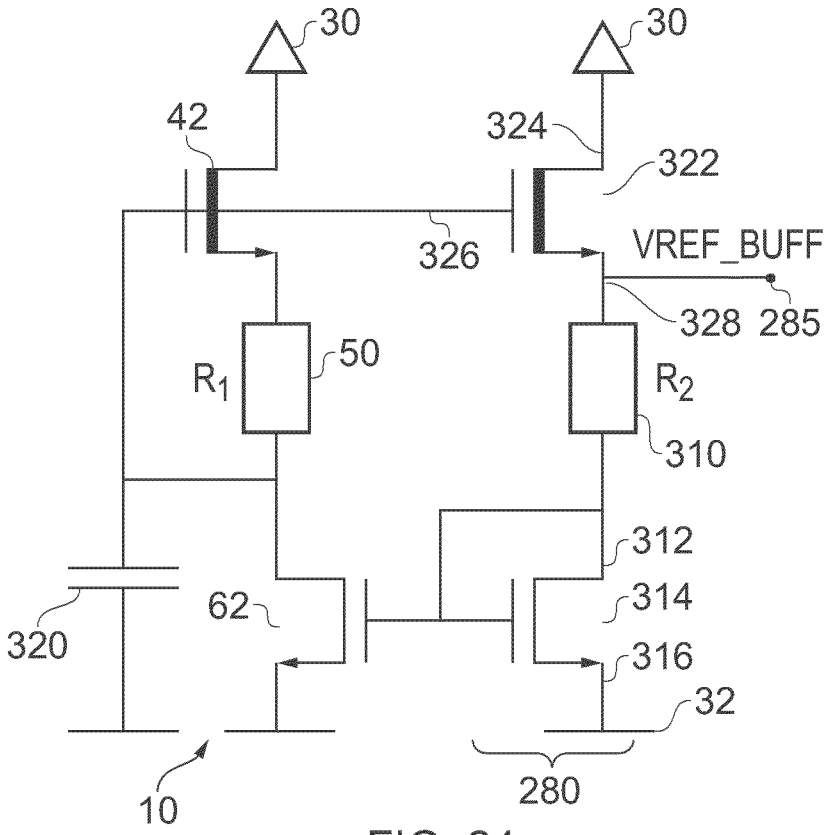
FIG. 24 illustrates an arrangement in which the buffer is integrated with the voltage reference.

To avoid loss of current to a circuit being driven by the voltage reference, a buffer 280 may be provided to buffer the voltage from the output node 56, for example, as shown in FIG. 23. The output buffer 280 can, if desired, be integrated with the voltage reference 10, for example, as shown in FIG. 24. The voltage reference 10 is constructed as described herein before. The native transistor 42 shown in FIG. 24 has its drain connected to the voltage supply 30, its source connected to first terminal of the resistor 50, its gate connected to second terminal of the resistor 50, and the drain of the second transistor 62. Such an arrangement was shown in FIG. 3.

In the arrangement shown in FIG. 12 the input transistor of the current minor is in series with the first transistor 242. However, as will now be explained it may be advantageous not to do this here.

It can be desirable that the buffer 280 does not turn into a source of voltage error or introduce extra temperature related effects. However it can also be desirable that the buffer 280 does not use lots of current, but at the same time it may be advantageous for the buffer 280 to be able to supply current into a load connected to the output 285 of the buffer 280.

The buffer 280 may also comprise a native transistor 322 (although a normal transistor or depletion mode transistor may also be used) whose drain 324 is connected to the voltage supply 30, whose gate 326 is connected to the gate of the first transistor 42 and whose source is connected to the output node 285 and also to a first node of an output stage resistor 310. A second node of the output stage resistor 310 is connected to a drain 312 of an N type FET 314. The source 316 of the transistor 314 is connected to a second supply voltage, such as the local 0V rail 32.

The FET 322 can be regarded as being a first buffer transistor and the FET 314 can be regarded as being a second buffer transistor. The second buffer transistor 314 has its gate connected to its drain 312, but also to the gate of the second transistor 62. Thus the transistors 314 and 62 form a current mirror with the second buffer transistor 314 acting as the master (or input transistor) and the transistor 62 acting as the slave (or output transistor), such that the current flow through the transistor 62 is proportional to the current flowing through transistor 314.

At power up, the gates of the first transistor 42 and the first buffer transistor 322 are both at approximately 0V, but both transistors can conduct because they are native devices, and consequently a current flows in the buffer 280, and by virtue of the current minor current also flows in the voltage reference 10. Thus the voltage reference 10 can establish its operation as described hereinbefore.

The circuit shown in FIG. 24 provides an arrangement having negative feedback. Suppose that the circuit is allowed to stabilize and no current is drawn from the output node 285. The voltage at the output node is the same as the voltage at the source of the first transistor 42, or at least very similar to it.

If a current flows out from the output 285, then $V_{gs}$ across the first transistor 42 increases to accommodate the additional current flow. As a result the output voltage at the output node 285 can drop by a relatively small amount. This in turn causes the voltage across the resistor 310 to drop by a relatively small amount, and the current flowing through the resistor 310, and hence the second buffer transistor 314 to decrease by a relatively small amount. The slight decrease in current is mirrored to the second transistor 62. With the second transistor 62 passing less current the voltage dropped across the first resistor 50 decreases, so the gate voltage of the first transistor 42 and the gate voltage of the first buffer transistor 322 increases slightly. This in turn causes the voltage at the output node 285 to rise a little. Thus a negative feedback loop can be formed. Similarly, if current flows into the output node 285, the voltage at the output node 285 would tend to increase as the first buffer transistor 322 would pass less current and hence $V_{gs}$ of the first buffer transistor 322 decreases, this causes more current to flow through the second buffer transistor 314 and by virtue of the current minor thought the second transistor 62. This causes the voltage drop across the resistor 50 to increase, and hence the gate voltages of transistors 42 and 322 to decrease. Again the negative feedback can act to stabilize the output voltage at node 285.

In order to inhibit oscillation, a capacitor 320 may be connected to the circuit to form a dominant pole.

In the circuit shown in FIG. 24, the dominant pole can be introduced by connecting the capacitor 320 between the gate of the first transistor 42 and ground.

This style of buffer can be used with any of the circuits described hereinbefore. A slight modification to suit the specific circuit configuration can be implemented.

Figure 25:
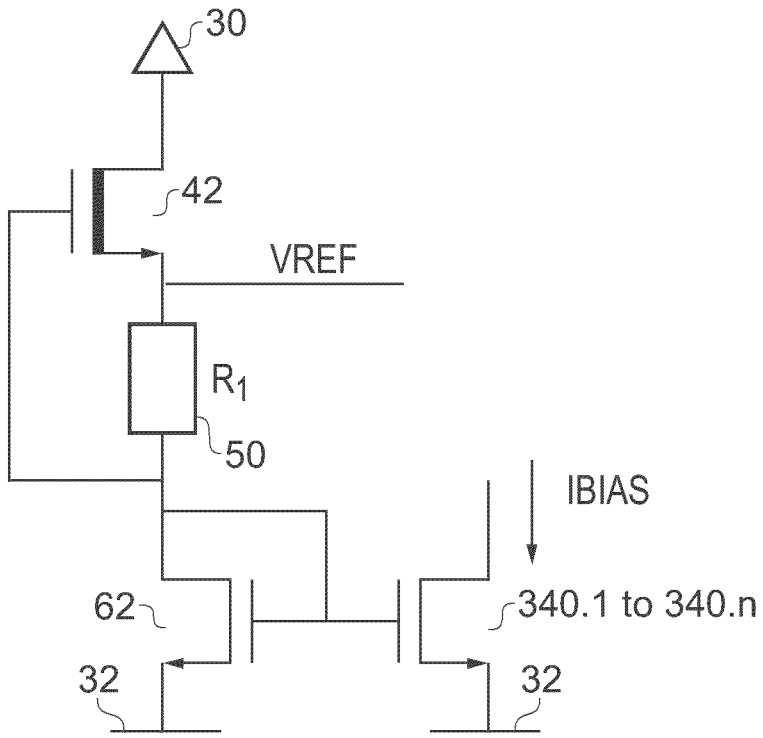
FIG. 25 shows how the voltage generator can be configured to supply current to other circuits.

As noted before, the voltage reference generator is self starting and stabilizes to a constant or substantially constant current. As a result it is suitable for forming a current minor arrangement for setting a bias current to other components in a circuit. Such an arrangement is shown in FIG. 25 where the circuit of FIG. 3 has been modified to include one or more FETs 340.1 to 340.n each having their gate connected to the gate of the second transistor 62. Thus each of the transistors 340.1 to 340.n will tend to pass a current at the same current density as the second transistor 62, and hence the actual current passed by any one of the transistors 304.1 to 340.n can be controlled by varying the device width (and hence aspect ratio) to give a multiplying coefficient for the current passed by a given one of the slave transistors 340.1 to 340.n compared to the current passed by the second transistor 62.

Figure 26:
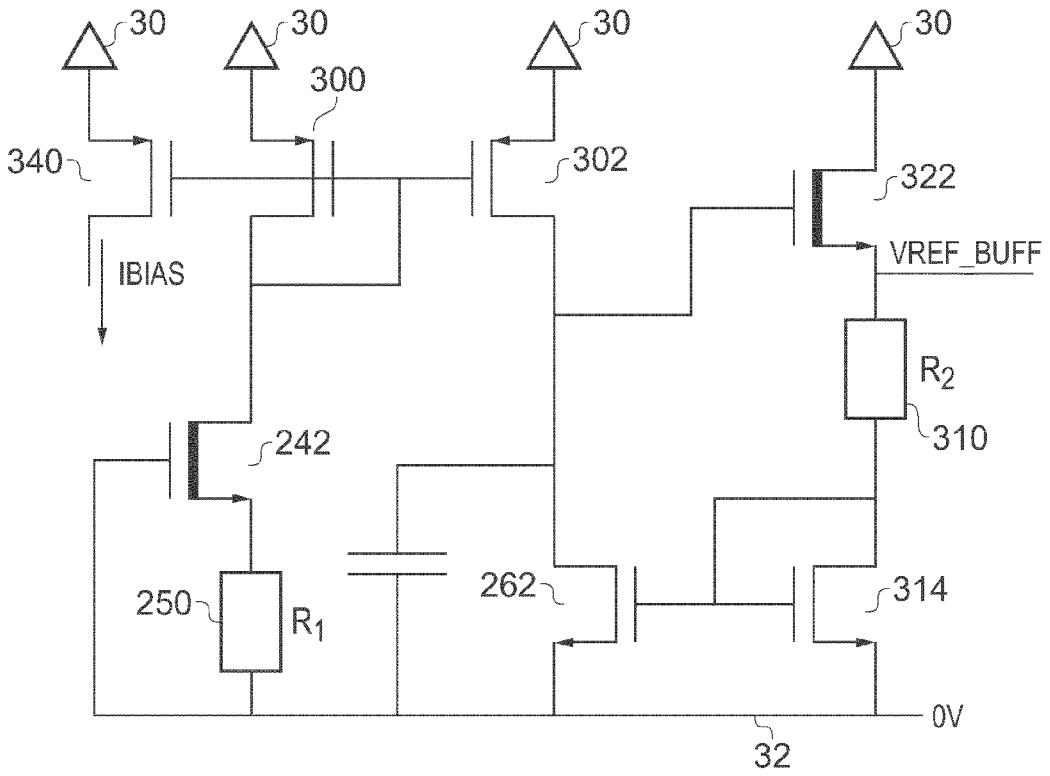
FIG. 26 shows a combination of a voltage reference 10 as described with respect to FIG. 12 in combination with a buffer as shown in FIG. 24 and a high side current mirror for controlling current flow in other circuits (not shown)

The 'mirror' can be formed on the low side or the high side of the first transistor. FIG. 25 has a current mirror formed on the low side of the first transistor 42, whereas FIG. 12 had one formed on the high side. The circuit of FIG. 12, having a minor, can be combined with the buffer of FIG. 24 as shown in FIG. 26.

Here, the first transistor 242 is a native transistor having a resistor 250 which has resistance $R_1$ connected between its source and the local ground or 0V rail 32. Current flow through the resistor 250 causes the gate of the first transistor 242 to be more negative than the source of the first transistor 242, and as this voltage increases, the first transistor 242 can act to reduce the amount of current flowing from its drain to its source. P type transistors 300 and 302, which in this example can be regarded as second and third transistors and which are shown as FETs but which could also be bipolar transistors, form a current mirror such that the current passing through the first transistor 242 is mirrored by the transistor 302 to flow through a fourth transistor 262 which is an N type FET having its drain connected to the drain of the third transistor 302 and its source connected to the 0V rail. The fourth transistor is part of the second stage. As described before, the buffer comprises first and second buffer transistors 322 and 304 and intermediate resistor 310. The second buffer transistor has its gate connected to its source, and also to the gate of the fourth resistor 262. The gate of the first buffer transistor 322 is connected to the drain of the third transistor 302. Such an arrangement provides a buffered output voltage and a negative feedback loop as described earlier.

Figure 27:
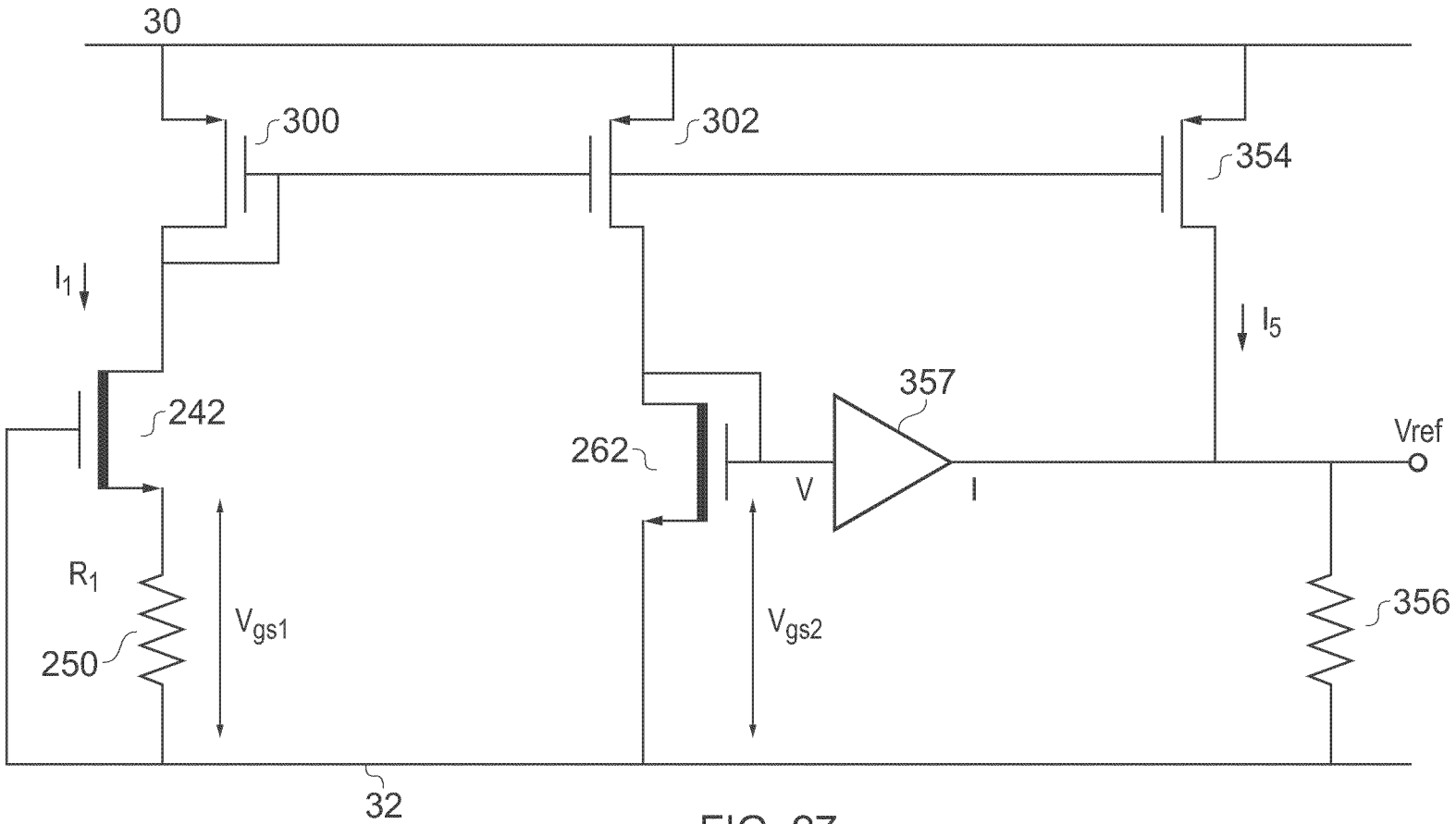
FIG. 27 shows another embodiment of a voltage reference circuit.

FIG. 27 shows a further arrangement for combining the responses of the first and second stages. The circuit expands on the arrangement shown in FIG. 12. Similar parts are designated with similar reference signs.

As in FIG. 12, the first stage comprises the first transistor 242 in series with the input transistor 300 of a current mirror formed with transistor 302. The source of the first transistor 242 is connected to ground by way of a resistor 250. The gate of the first transistor is also connected to ground. Thus as before, it acts to form a current source with $V_{gs1} \phi V_{TH1} = -R_1 I_1$ (where $\phi$ represents "approximately equal to).

This has a positive temperature coefficient. In FIG. 12 this current was converted to a voltage by flowing through the diode connected transistor 262, which has a voltage across it of $V_{gs2}$ and a negative temperature coefficient. A voltage change was also caused by the product $I_2R_2$ but $I_2$ was proportional to $I_1$.

The summation need note be done at the second stage. FIG. 27 shows an arrangement where the current from the first stage is still supplied to the second stage via the current mirror formed by transistors 300 and 302. The second stage transistor 262 is diode connected, so the gate voltage has a negative temperature coefficient, as was the case with the FIG. 12 embodiment, and the current through the first stage still has a positive temperature coefficient, as was also the case with FIG. 12. The second stage transistor 262 can conveniently be thought of as a fourth transistor.

Summation of the responses of the first and second stages can be performed by a summing circuit which comprises a fifth transistor 354 in current minor configuration with the current minor input transistor 300. The current $I_5$ through the fifth transistor 354 can be proportional to $I_1$, and can be converted to an output voltage $V_{O1}$ having a positive temperature coefficient by passing through an output resistor 356 having a resistance $R_3$.

Therefore $$V_{O1} = I_5 \times R_3 = T_1 \times \frac{-V_{gs1}}{R_1} \times R_3$$

where $T_1$ is a scaling factor between transistor 300 and transistor 354.

Meanwhile the gate-source voltage of the transistor 262 which is the second stage transistor so it is still designated $V_{gs2}$ can be converted into a current by a transconductance circuit 357 having a voltage to current transfer ratio $T_2$. This current has a negative temperature coefficient.

The current can then be summed with the positive temperature coefficient, so that the output response becomes $$\begin{aligned} V_{out} &= V_{ou1} + V_{ou2} \\ &= V_{ou1} + V_{gs2} \times T_2 \times R_3 \end{aligned}$$

$$V_{out} = \left(T_2 V_{gs2} - \frac{V_{gs1}}{R_1} T_1\right) \times R_3$$

The voltage $V_{gs2}$ can be converted to a current I by comparing the voltage across a further resistor to $V_{gs2}$, so $T_2$ can have a term proportional to $I/R_2$ This means the transfer component can be varied by terms T1 and T2 which now represent current scaling factors, and resistances R1, R2 and R3 so $$V_{out} = R_3\left[\left(\frac{V_{gs2} T_2}{R_2}\right) - \left(\frac{V_{gs1} T_1}{R_1}\right)\right]$$

Figure 28:
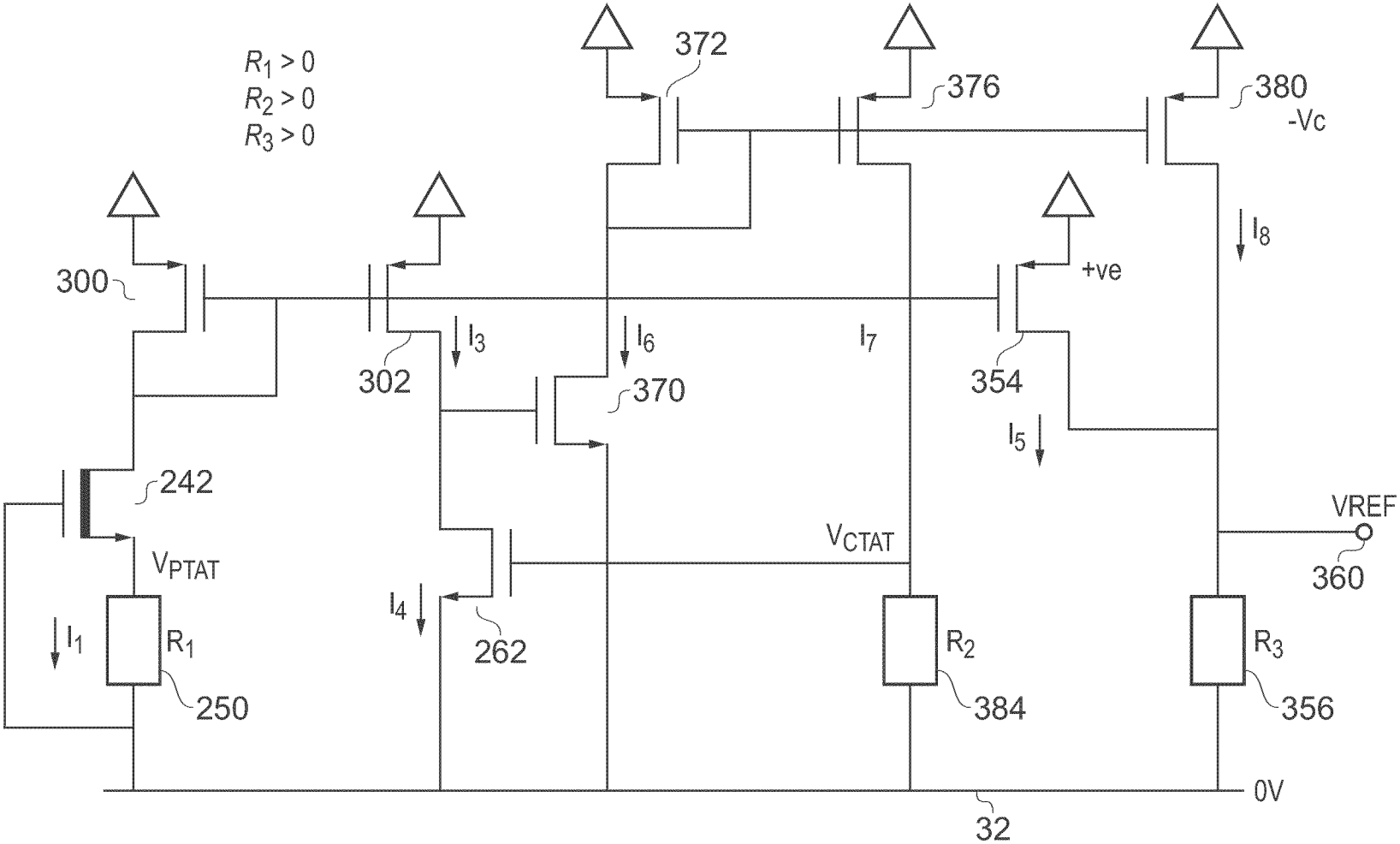
FIG. 28 shows a detailed implementation of another embodiment of a voltage reference circuit.

FIG. 28 shows an implementation of the circuit of FIG. 27. The circuit has a first part comprising four transistors in a configuration as described with respect to FIG. 26, and for ease of reference the same names and reference numerals will be used. Thus the first to fourth transistors 242, 300, 302 and 262 of FIG. 27 are similarly configured in FIG. 28.

A gate of a fifth transistor 354 is also connected to the gate of the second transistor 300 such that it also minors the current flowing in the first transistor 242 as a current $I_5$ in a current flow path through a resistor 356 having a value $R_3$. A first node of the resistor 356 forms an output node 360, and a second node of the resistor 356 is connected to the 0V rail.

A sixth transistor 370 has its gate connected to the drain of the fourth transistor 262, and its source connected to the 0V rail. In some other implementations, a resistor can be connected between the source of the sixth transistor 370 and the 0V rail 32. The drain of the sixth transistor 370 is connected to a current minor formed by seventh, eighth and ninth transistors 372, 376 and 380, respectively. Thus the current flowing through the sixth transistor 370 is mirrored by the seventh transistor 376 as $I_7$ to flow through a resistor 384 having a resistance $R_2$. The gate of the fourth transistor is connected to receive the voltage across the resistor 384.

In use, the current $I_4$ through the fourth transistor 262 should be the same as the current $I_3$ through the third transistor 302, and consequently any current imbalance can cause a change in the gate voltage of the sixth transistor 370.

Further, the current $I_7$ flowing through the seventh transistor 376 can be related to a current $I_6$ flowing through the sixth transistor 370, which under steady state conditions is proportional to the current I4 in the fourth transistor.

The sixth transistor 370, and the current minor formed by transistors 372 and 376 and resistor 384 form a feedback loop, such that the current $I_6$ is dictated by the gate-source voltage of the fourth transistor 262, which being a semiconductor has a negative temperature coefficient.

The current in the sixth transistor 370 is mirrored by the eighth transistor 380, as current $I_8$. From inspection we see $I_7$ is related to the Vgs of the fourth transistor 262, is a negative response, and that the voltage is scaled by $R_2$ in FIG. 28. Further $I_7$ and $I_8$ are proportional to each other, as illustrated.

We can also see that $I_5$ can be directly related to the voltage across $R_1$ and $V_{gs1}$ and so has a positive temperature coefficient $K_1$, and $I_8$ is proportional to $I_7$ which is proportional to $V_{gs2}$ for the fourth transistor 262, and has a negative temperature coefficient. Thus, the responses can be combined as was described with respect of FIG. 27.

The gain by the current mirrors allow the voltage to be set to any desired output voltage within the supply voltage range, and the ratios of the resistors allow the temperature coefficients to be cancelled.

It can be seen that the fifth and eighth transistors are of the same type, so changes in their responses due to temperature should affect the positive and negative components by an equal amount, and temperature coefficients of the resistors should also cancel.

It is thus possible to provide a reliable and compact generator suited for inclusion in an integrated circuit.

It should be noted that although the term MOSFET is used herein, the meaning of the term has evolved since it was originally devised, and the gate electrode need not be made of metal, but formed of other materials such as conductive polysilicon.

Although the claims have been presented in single dependency format for use at the USPTO, each claim can depend on any preceding claim of the same type, except when that is clearly infeasible.

The circuits and methods for voltage generation and/or power on reset are described above with reference to certain embodiments. A skilled artisan will, however, appreciate that the principles and advantages of the embodiments can be used for any other systems, apparatus, or methods with a need for voltage generation and/or power on reset.

Such systems, apparatus, and/or methods can be implemented in various electronic devices. Examples of the electronic devices can include, but are not limited to, consumer electronic products, parts of the consumer electronic products, electronic test equipment, etc. Examples of the electronic devices can also include memory chips, memory modules, circuits of optical networks or other communication networks, and disk driver circuits. The consumer electronic products can include, but are not limited to, precision instruments, medical devices, wireless devices, a mobile phone (for example, a smart phone), cellular base stations, a telephone, a television, a computer monitor, a computer, a hand-held computer, a tablet computer, a personal digital assistant (PDA), a microwave, a refrigerator, a stereo system, a cassette recorder or player, a DVD player, a CD player, a digital video recorder (DVR), a VCR, an MP3 player, a radio, a camcorder, a camera, a digital camera, a portable memory chip, a washer, a dryer, a washer/dryer, a copier, a facsimile machine, a scanner, a wrist watch, a clock, etc. Further, the electronic device can include unfinished products.

Unless the context clearly requires otherwise, throughout the description and the claims, the words "comprise," "comprising," "include," "including," and the like are to be construed in an inclusive sense, as opposed to an exclusive or exhaustive sense; that is to say, in the sense of "including, but not limited to." The words "coupled" or "connected", as generally used herein, refer to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words in the Detailed Description using the singular or plural number may also include the plural or singular number, respectively. The words "or" in reference to a list of two or more items, is intended to cover all of the following interpretations of the word: any of the items in the list, all of the items in the list, and any combination of the items in the list. All numerical values or distances provided herein are intended to include similar values within a measurement error.

The teachings of the inventions provided herein can be applied to other systems, apparatus, and/or methods other than those described above. The elements and acts of the various embodiments described above can be combined to provide further embodiments.

While certain embodiments of the inventions have been described, these embodiments have been presented by way of example only, and are not intended to limit the scope of the disclosure. Indeed, the novel methods, systems, and apparatus described herein may be embodied in a variety of other forms. Furthermore, various omissions, substitutions and changes in the form of the methods, systems, and apparatus described herein may be made without departing from the spirit of the disclosure. The accompanying claims and their equivalents are intended to cover such forms or modifications as would fall within the scope and spirit of the disclosure. Accordingly, the scope of the present inventions is defined by reference to the claims.

What is claimed is:

1. A voltage generator comprising:

first and second coupled stages, wherein the first stage has a voltage versus temperature characteristic which is opposite to a voltage versus temperature characteristic of the second stage, wherein the first stage comprises:

a first transistor having a gate, a drain and a source, the first transistor configured to pass a current when its gate voltage is approximately the same as its source voltage, and a first resistive element having a first node and a second node, the first node being connected to the source of the first transistor and the second node being connected to the gate of the first transistor;

wherein the second stage comprises an enhancement mode transistor, and wherein a node at which the first stage is coupled to the second stage is configured to provide a temperature compensated voltage due at least partly to a temperature coefficient of the first transistor and a temperature coefficient of the enhancement mode transistor.

2. A voltage generator as claimed in claim 1, in which the enhancement mode transistor has a gate, a drain and a source, and wherein the gate of the enhancement mode transistor is connected to the drain of the enhancement mode transistor.

3. A voltage generator as claimed in claim 2, in which the second stage further comprises a second resistive element in series with the drain of the enhancement mode transistor.

4. A voltage generator as claimed in claim 2, in which the enhancement mode transistor comprises a plurality of series connected transistors.

5. A voltage generator as claimed in claim 2, further comprising a third stage connected in series with the second stage.

6. A voltage generator as claimed in claim 5, wherein the third stage comprises at least one of a resistor and a diode connected field effect transistor.

7. A voltage generator as claimed in claim 1, in which the first transistor is a native transistor or a depletion mode transistor.

8. A voltage generator as claimed in claim 1, further comprising a cascode transistor coupled between the first transistor and a supply rail for the first transistor.

9. A voltage generator as claimed in claim 1, in which the first and second stages are connected in series, and the second stage is connected to the second node of the first resistive element.

10. A voltage generator as claimed in claim 1, in which an output is connected to the first node of the first resistive element.

11. A voltage generator as claimed in claim 1, in which the temperature coefficient of the enhancement mode transistor is negative.

12. A voltage generator as claimed in claim 1, in which the first and second stages are coupled via a current mirror such that the current flowing in the second stage is proportional to the current flowing in the first stage.

13. A voltage generator as claimed in claim 12, in which the second stage further comprises a second resistive element coupled between the enhancement mode transistor and an output node of the current mirror.

14. A voltage generator as claimed in claim 13, in which the second resistive element comprises a semiconductor device.

15. A voltage generator as claimed in claim 1 further comprising an output stage to buffer an output voltage provided by the first and second coupled stages.

16. A voltage generator as claimed in claim 15 in which the second stage is coupled to the first stage by a current mirror, and the enhancement mode transistor of the second stage is a slave transistor in a current mirror configuration with a transistor of the output stage.

17. A voltage generator as claimed in a claim 16, in which the output stage comprises a first output stage transistor and a second output stage transistor connected by a resistor, and a gate of the first output stage transistor is connected to a drain of the slave transistor, and the second output stage transistor is in a diode connected configuration and has its gate connected to the gate of the slave transistor.

18. A voltage generator as claimed in claim 1 in which a current flowing through the first stage is mirrored to the second stage and to a first output device, and the current flowing in the second stage is used by a feedback circuit to generate a second stage control current which is mirrored to a second output device, and where the currents of the first and second output devices have complementary temperature coefficients, and are combined to generate an output signal.

19. A voltage generator as claimed in claim 1, in which the first resistive element is a resistor or a transistor.

20. A voltage generator as claimed in claim 1, in which the first transistor is formed by a plurality of series connected transistors.

21. A voltage generator as claimed in claim 1, in which a temperature coefficient of an output voltage at an output of the voltage generator is less than a temperature coefficient of the first and second stages.

22. A voltage generator as claimed in claim 21 in which the output voltage has a temperature coefficient of less than 20% of the coefficient of one of the first and second stages.

23. A power up reset circuit comprising the voltage generator of claim 1.

24. A power up reset circuit as claimed in claim 23, wherein the second stage comprises a diode or a diode connected transistor.

25. A power up reset circuit as claimed in claim 23, further comprising a comparator having a current therethrough controlled by a current source or sink, wherein the enhancement mode transistor is diode connected, and wherein the current source or sink comprises a device of the same technology as the enhancement mode transistor.

26. A power up reset circuit as claimed in claim 23, further including a reference limb comprising a voltage translation circuit.

27. A method of generating a reference voltage, the method comprising providing a voltage to a reference generator comprising first and second stages in current flow communication, wherein the first stage has a temperature coefficient of a first sign and the second stage has a temperature coefficient of a second sign, and wherein the first stage comprises a first resistive element and first transistor having a gate, a drain and a source, wherein a first node of the first resistive element is connected to the source of the first transistor, a second node of the first resistive element is connected to a gate of the first transistor, and the first transistor is configured to pass a current when its gate voltage is approximately the same as its source voltage, wherein the second stage comprises an enhancement mode transistor, and wherein a node at which the first stage is coupled to the second stage is configured to provide a temperature compensated voltage due at least partly to a temperature coefficient of the first transistor and a temperature coefficient of the enhancement mode transistor.

28. A method as claimed in claim 27, in which the first stage has a temperature coefficient which is positive, and the second stage has a temperature coefficient which is negative and a current flow communication sums the responses of the first and second stages.

29. A method as claimed in claim 27, in which a summed result is translated to an output voltage by observing the voltage difference across a transistor in the second stage or a sum of the gate-source voltages of transistors in the first and second stages.

30. A voltage generator comprising:

a first stage comprising:

a first transistor having a gate, a drain and a source, the first transistor configured to pass a current when its gate voltage is approximately the same as its source voltage;

a first resistive element having a first node and a second node, the first node being connected to the source of the first transistor and the second node being connected to the gate of the first transistor; and a cascode transistor coupled between the first transistor and a supply rail for the first transistor, the cascode transistor having a gate configured to receive a reference voltage output by the voltage generator; and a second stage coupled to the first stage, wherein the first stage has a voltage versus temperature characteristic which is opposite to a voltage versus temperature characteristic of the second stage.

31. A voltage generator as claimed in claim 30, wherein the second stage comprises a diode connected enhancement mode transistor, and wherein a node at which the first stage is coupled to the second stage is configured to provide a temperature compensated voltage due at least partly to a temperature coefficient of the first transistor and a temperature coefficient of the enhancement mode transistor.

* * * * *